US009566646B2

(12) United States Patent
Shigeoka et al.

(10) Patent No.: US 9,566,646 B2
(45) Date of Patent: Feb. 14, 2017

(54) SURFACE-TREATED RARE EARTH-BASED MAGNETIC PARTICLES, RESIN COMPOSITION FOR BONDED MAGNETS COMPRISING THE EARTH-BASED MAGNETIC PARTICLES AND BONDED MAGNET COMPRISING THE EARTH-BASED MAGNETIC PARTICLES

(75) Inventors: Kuniyoshi Shigeoka, Hiroshima-ken (JP); Nobuhiro Katayama, Hiroshima-ken (JP)

(73) Assignee: TODA KOGYO CORPORATION, Hiroshima (JP)

( * ) Notice: Subject to any disclaimer, the term of this patent is extended or adjusted under 35 U.S.C. 154(b) by 1194 days.

(21) Appl. No.: 13/147,274

(22) PCT Filed: Feb. 3, 2010

(86) PCT No.: PCT/JP2010/051530

§ 371 (c)(1),
(2), (4) Date: Sep. 12, 2011

(87) PCT Pub. No.: WO2010/090229

PCT Pub. Date: Aug. 12, 2010

(65) Prior Publication Data

US 2011/0315913 A1 Dec. 29, 2011

(30) Foreign Application Priority Data

Feb. 3, 2009 (JP) ..... 2009-023093

(51) Int. Cl.
*H01F 1/057* (2006.01)
*B22F 1/02* (2006.01)
(Continued)

(52) U.S. Cl.
CPC . *B22F 1/02* (2013.01); *B22F 3/14* (2013.01); *C22C 33/0278* (2013.01);
(Continued)

(58) Field of Classification Search
CPC ..... B22F 1/02; H01F 1/0572
(Continued)

(56) References Cited

U.S. PATENT DOCUMENTS 4,497,722 A * 2/1985 Tsuchida ..... H01F 1/061 252/62.54
4,988,755 A * 1/1991 Dickens, Jr. ..... C08G 59/4085 252/62.54
(Continued)

FOREIGN PATENT DOCUMENTS

JP 2003-86410 3/2003
JP 2006-49863 2/2006
(Continued)

OTHER PUBLICATIONS

International Search Report for PCT/JP2010/051530, mailed May 18, 2010.
(Continued)

*Primary Examiner* — Matthew E Hoban
(74) *Attorney, Agent, or Firm* — Nixon & Vanderhye P.C.

(57) ABSTRACT

The present invention relates to surface-treated rare earth-based magnetic particles comprising rare-earth-based magnetic particles, a first coating layer comprising a phosphoric acid compound which is formed on a surface of the respective magnetic particles and a second coating layer in the form of a composite coating film comprising a silicon compound and a phosphoric acid compound which is formed on a surface of the first coating layer, wherein an amount of Fe eluted from the rare earth-based magnetic particles is not more than 10 mg/L; a resin composition for bonded magnets comprising the above surface-treated rare earth-based magnetic particles and a resin; and a bonded magnet comprising the above surface-treated rare earth-based magnetic particles.

11 Claims, 2 Drawing Sheets

(51) Int. Cl.
*B22F 3/14* (2006.01)
*C22C 33/02* (2006.01)
*H01F 1/059* (2006.01)

(52) U.S. Cl.
CPC ..... *H01F 1/0572* (2013.01); *C22C 2202/02* (2013.01); *H01F 1/059* (2013.01); *H01F 1/0578* (2013.01)

(58) Field of Classification Search
USPC ..... 252/62.55, 62.57
See application file for complete search history.

(56) References Cited

U.S. PATENT DOCUMENTS

2002/0084440 A1* 7/2002 Ohmori ..... B22F 1/02 252/62.54
2006/0099404 A1* 5/2006 Yoshimura ..... B22F 1/02 428/323
2007/0235109 A1 10/2007 Maeda et al.
2009/0096561 A1* 4/2009 Menjo ..... H01F 1/0552 335/302
2010/0255188 A1 10/2010 Maeda et al.

FOREIGN PATENT DOCUMENTS

JP 2006-169618 * 6/2006
JP 2006-245173 9/2006
JP 2007-048951 2/2007
JP 2008-263040 10/2008

OTHER PUBLICATIONS

Partial Human Translation of Japanese Patent Application Laid-Open No. 2006-169618.
Extended European Search Report issued in EP Application No. 10738560.1 dated May 8, 2015.

* cited by examiner

SURFACE-TREATED RARE EARTH-BASED MAGNETIC PARTICLES, RESIN COMPOSITION FOR BONDED MAGNETS COMPRISING THE EARTH-BASED MAGNETIC PARTICLES AND BONDED MAGNET COMPRISING THE EARTH-BASED MAGNETIC PARTICLES

This application is the U.S. national phase of International Application No. PCT/JP2010/051530, filed 3 Feb. 2010, which designated the U.S. and claims priority to Japan Application No. 2009-023093, filed 3 Feb. 2009, the entire contents of each of which are hereby incorporated by reference.

TECHNICAL FIELD

The present invention relates to rare earth-based magnetic particles for bonded magnets comprising Nd—Fe—B-based magnetic particles or Sm—Fe—N-based magnetic particles which are excellent in rust prevention property, a resin composition for bonded magnets which comprises the rare earth-based magnetic particles, and a bonded magnet comprising the rare earth-based magnetic particles.

BACKGROUND ART

Bonded magnets have been conventionally used various extensive applications such as electrical appliances and automobile parts owing to a good shape adjustability and a high dimensional accuracy. In recent years, with the tendency toward reduction in size and weight of these electrical appliances and automobile parts, it has been strongly required that the bonded magnets per se used therein have a high performance and a high corrosion resistance capable of withstanding severe environmental conditions.

The bonded magnets have been in general produced by kneading magnetic particles together with a binder resin such as rubbers and plastic materials and then molding the resulting kneaded material. Therefore, in order to obtain the bonded magnets having a high performance, it has been strongly required that the magnetic particles used therein have a high performance, i.e., exhibit a large residual magnetic flux density Br and a high coercive force ${}_iH_c$ and as a result, a large magnetic energy product $(BH)_{max}$.

As the magnetic particles, there are known magnetoplumbite-based ferrites such as barium ferrite and strontium ferrite, Nd—Fe—B-based magnetic particles and Sm—Fe—N-based magnetic particles.

The Nd—Fe—B-based magnetic particles have been extensively applied to high-efficiency motors owing to both a high saturation magnetization and a high anisotropic magnetic field thereof. Sintered magnets have been extensively used in the applications including not only mobile phones and various domestic appliances but also large-scale magnetic circuits for magnetic medical diagnosis equipments (MRI), radiation generators and the like. The bonded magnets have been used in the applications including spindle motors for CD, DVD and HDD, vibration motors for mobile phones, actuators for digital cameras, etc. In addition, studies have been made to apply these magnets to automobile parts for the purposes of weight reduction, energy saving and improved performance thereof.

The Sm—Fe—N-based magnetic particles have both a high saturation magnetization and a high anisotropic magnetic field similarly to the Nd—Fe—B-based magnetic particles. In addition, the Sm—Fe—N-based magnetic particles also have a high Curie temperature and therefore have been recently noticed. In particular, the Sm—Fe—N-based magnetic particles have a higher rust prevention property than that of the Nd—Fe—B-based magnetic particles. Therefore, it has been expected that the Sm—Fe—N-based magnetic particles are used under severe environmental conditions in which bonded magnets formed of the Nd—Fe—B-based magnetic particles are not usable.

The Nd—Fe—B-based magnetic particles may be produced, for example, by the method in which an alloy mass comprising neodymium, iron and boron is treated at an elevated temperature in a hydrogen atmosphere to once decompose the alloy into a rare earth hydride, and an Fe compound and an Fe—B compound, i.e., subject the alloy to hydrogenation and disproportionation (HD treatment), and then remove hydrogen from the resulting particles to obtain purified fine compound crystals again (DR treatment). However, it is required that the size of the thus obtained Nd—Fe—B-based magnetic particles is adequately adjusted in order to apply the magnetic particles to a magnet. Therefore, the Nd—Fe—B-based magnetic particles must be subjected to crushing treatment at least to a minimum extent. The crushing treatment tends to however cause exposure of an active surface of the respective magnetic particles to outside, so that the Nd—Fe—B-based magnetic particles tend to suffer from promoted oxidation owing to exposure of the active surface. In particular, the Nd—Fe—B-based magnetic particles tend to be readily oxidized for a short period of time in a wet air, resulting in deterioration in magnetic properties thereof. Further, when subjected to a kneading step with a resin and a molding step, the Nd—Fe—B-based magnetic particles tend to suffer from deterioration in magnetic properties thereof owing to an oxidizing or reducing atmosphere used in these steps or heat generated therein. In addition, the Nd—Fe—B-based magnetic particles are very likely to be rusted owing to inclusion of Fe. In the case where a bonded magnet formed of the Nd—Fe—B-based magnetic particles is used in corrosive environmental conditions such as sea coast, the bonded magnet tends to suffer from formation of rusts even when the bonded magnet is produced using a low water-absorbing resin.

On the other hand, the Sm—Fe—N-based magnetic particles may be produced by occlusion of nitrogen into an alloy of samarium and iron. The size of Sm—Fe—N-based magnetic particles must be adequately adjusted in order to obtain a permanent magnet therefrom. Therefore, the Sm—Fe—N-based magnetic particles must also be subjected to crushing treatment at least to a minimum extent. The crushing treatment tends to however cause exposure of an active surface of the respective magnetic particles to outside, so that the Sm—Fe—N-based magnetic particles tend to suffer from promoted oxidation owing to exposure of the active surface. In particular, the Sm—Fe—N-based magnetic particles tend to be readily oxidized for a short period of time in a wet air, resulting in deterioration in magnetic properties thereof. Further, when subjected to a kneading step with a resin and a molding step, the Sm—Fe—N-based magnetic particles tend to suffer from deterioration in magnetic properties thereof owing to an oxidizing or reducing atmosphere used in these steps or heat generated therein. Also, although the Sm—Fe—N-based magnetic particles are less rusted as compared to the Nd—Fe—B-based magnetic particles, the Sm—Fe—N-based magnetic particles tend to be decomposed at an elevated temperature. Therefore, the Sm—Fe—N-based magnetic particles tend to be used together with only a low-melting resin such as epoxy resins and polyamide resins when forming a bonded magnet therefrom, and therefore tend to gradually absorb water to generate rusts therein. For example, when used in corrosive environmental conditions such as sea coast, the Sm—Fe—N-based magnetic particles tend to be suffer from formation of rusts. When kneaded with super-engineering plastics having a high melting point, the Sm—Fe—N-based magnetic particles tend to be considerably deteriorated in coercive force, thereby failing to obtain a bonded magnet having magnetic properties as aimed.

Thus, it has been strongly required to provide the Nd—Fe—B-based magnetic particles and the Sm—Fe—N-based magnetic particles which are less deteriorated in magnetic properties thereof even when exposed to an oxidizing or reducing atmosphere or heat generation which will be caused in each of drying, surface-treating, kneading and molding steps, and a bonded magnet formed of these magnetic particles which are hardly rusted even when used in corrosive environmental conditions.

Also, a moldability of the bonded magnet is an important property upon practical use, but tends to vary depending upon a fluidity of a mixture of the magnetic particles and a resin under high-temperature and high-pressure conditions. Therefore, it is important that the magnetic particles have a good resistance to chemical reactions upon molding with the resins.

There is conventionally known a method of surface-treating Nd—Fe—B-based magnetic particles to enhance an oxidation resistance thereof in which the magnetic particles are coated with a phosphoric acid-based compound (Patent Document 1). Also, there is known a method of forming an $SiO_2$ protective film on the respective Nd—Fe—B-based magnetic particles (Patent Document 2).

There is also known a method of surface-treating Sm—Fe—N-based magnetic particles to enhance an oxidation resistance thereof in which the magnetic particles are coated with a phosphoric acid-based compound (Patent Document 3). In addition, there is known a method of surface-treating Sm—Fe—N-based magnetic particles to enhance an oxidation resistance thereof in which a silica coating film is formed on the respective magnetic particles (Patent Documents 4 to 6). Further, there is known a method in which after Sm—Fe—N-based magnetic particles are coated with a phosphoric acid-based compound, a silica coating film is further formed on the respective coated magnetic particles (Patent Documents 7 and 8).

Patent Document 1: Japanese Patent Application Laid-Open (KOKAI) No. 2006-49863

Patent Document 2: Japanese Patent Application Laid-Open (KOKAI) No. 8-111306

Patent Document 3: Japanese Patent Application Laid-Open (KOKAI) No. 2000-260616

Patent Document 4: Japanese Patent Application Laid-Open (KOKAI) No. 2000-160205

Patent Document 5: Japanese Patent Application Laid-Open (KOKAI) No. 2000-309802

Patent Document 6: Japanese Patent Application Laid-Open (KOKAI) No. 2005-286315

Patent Document 7: Japanese Patent Application Laid-Open (KOKAI) No. 2002-8911

Patent Document 8: Japanese Patent Application Laid-Open (KOKAI) No. 2002-43109

DISCLOSURE OF THE INVENTION

Problems to be Solved by the Invention

In the above Patent Document 1, it is described that the magnetic particles are treated with a treating solution comprising flake-like fine particles of at least one substance selected from the group consisting of Al, Mg, Ca, Zn, Si, Mn and an alloy of these elements, and silane and/or a partially hydrolyzed product of silane to form a treating film thereon and thereby enhance a corrosion resistance thereof. However, even the bonded magnet formed of the thus treated magnetic particles tend to suffer from formation of rusts and deterioration in magnetic properties thereof under severe conditions, for example, when the bonded magnet is dipped in a salt water having a NaCl concentration of 5% which is almost identical to that in sea water or in an $SO_4^{2-}$-containing solution. In the method described in Patent Document 1, the permanent magnet after being molded is treated with the treating solution using a spray gun such that the thickness of the resulting heated composite coating film is 10 μm. Further, in the method, the heat treatment is carried out in a hot-air drying furnace at a temperature as high as 300° C. Therefore, the method described in Patent Document 1 is unpractical in view of investment of necessary facilities and production efficiency.

In the above Patent Document 2, there is described the method of forming a silicon dioxide protective film on the surface of the respective Nd—Fe—B-based magnetic particles by a plasma chemical vapor deposition method, and it is further described that when forming the $SiO_2$ coating film on the magnetic particles, the thus coated magnetic particles were free from formation of rusts even after the particles were held in a thermo-hygrostat maintained at 80° C. and 95% RH, and a rate of decrease in open flux thereof was also small. The bonded magnet produced from the thus treated magnetic particles exhibits a certain effect when evaluated for a corrosion resistance thereof in a thermo-hygrostat maintained at 80° C. and 95% RH, but tends to suffer from formation of rusts and be deteriorated in magnetic properties under more severe conditions, for example, when the bonded magnet is dipped in a salt water having a NaCl concentration of 5%.

In the above Patent Document 3, it is described that when the magnetic particles are coated with the phosphoric acid-based compound, the bonded magnet formed from the thus coated magnetic particles can be prevented from suffering from an increased rate of decrease in open flux thereof. However, in Patent Document 3, there is no specific description concerning rusts.

In the above Patent Document 4, it is described that the magnetic particles on which a coating film of fine silica particles is formed are improved such that a degree of deterioration in magnetic properties thereof is considerably reduced even after subjected to accelerated deterioration test. However, in Patent Document 4, there is no specific description concerning rusts.

In the above Patent Document 5, it is described that the bonded magnet produced using the magnetic particles on which a silica coating film is formed can be prevented from suffering from an increased rate of decrease in open flux thereof when a magnetic flux is measured after heating the bonded magnet for a predetermined time at 100° C., and therefore exhibit an extremely high stability with time. However, in Patent Document 5, there is no specific description concerning rusts.

In the above Patent Document 6, it is described that when the bonded magnet produced using the magnetic particles on which a silica coating film is formed is improved such that deterioration in the magnetic properties thereof is minimized under use conditions thereof, in particular, even when the bonded magnet is used under a high humidity condition at a temperature of not lower than 150° C. for a long period of time, and further formation of rusts in the bonded magnet can be suppressed even when the bonded magnet is held at 65° C. and 95% RH for 900 hr. However, the bonded magnet tends to suffer from formation of rusts and deterioration in magnetic properties thereof when used under more severe conditions, for example, when the bonded magnet is dipped in a salt water having a NaCl concentration of 5% which is almost identical to that in sea water or in an $SO_4^{2-}$-containing solution.

In the above Patent Documents 7 and 8, it is described that the magnetic particles whose surface is densely coated with the phosphoric acid-based compound were free from formation of rusts even when the magnetic particles were allowed to stand under environmental conditions of 85° C. and 85% RH for 20 days. However, the bonded magnet tends to suffer from formation of rusts and deterioration in magnetic properties thereof when used under more severe conditions, for example, when the bonded magnet is dipped in a salt water having a NaCl concentration of 5% which is almost identical to that in sea water or in an $SO_4^{2-}$-containing solution.

For example, when the bonded magnet produced using the Nd—Fe—B-based magnetic particles or the Sm—Fe—N-based magnetic particles is used in a motor, once rusts are formed thereon, there is caused such a possibility that the bonded magnet is deteriorated in performance owing to deterioration in magnetic properties of the magnetic particles, or causes motor lock and therefore undergoes damage by heat. In addition, there tends to arise such a problem that peripheral equipments are contaminated by the rusts generated.

In consequence, an object or technical task of the present invention is to provide Nd—Fe—B-based magnetic particles and Sm—Fe—N-based magnetic particles for bonded magnets which are more excellent in rust prevention property and can be produced by simplified treatments.

Means for Solving the Problem

The present inventors have considered that the Nd—Fe—B-based magnetic particles and the Sm—Fe—N-based magnetic particles can be enhanced in rust prevention property by forming a dense coating layer capable of suppressing elution of Fe therefrom on the surface of the respective magnetic particles. As a result of the present inventors' earnest study on various materials for the coating layer, it has been found that when coating the magnetic particles with a phosphoric acid compound and then treating the thus coated magnetic particles with an alkoxy oligomer whose molecular end is capped with an alkoxysilyl group, and phosphoric acid under specific conditions, the resulting composite coating layer of the silicon compound and phosphoric acid is most effective for achieving the above purposes. The present invention has been attained based on the above finding.

Thus, the above-mentioned object or technical task concerning the Nd—Fe—B-based magnetic particles and the Sm—Fe—N-based magnetic particles can be accomplished according to the following aspects of the present invention.

That is, according to the present invention, there are provided surface-treated rare earth-based magnetic particles comprising:

rare-earth-based magnetic particles, a first coating layer comprising a phosphoric acid compound which is formed on a surface of the respective rare earth-based magnetic particles and a second coating layer in the form of a composite coating film comprising a silicon compound and a phosphoric acid compound which is formed on a surface of the first coating layer, wherein an amount of Fe eluted from the rare earth-based magnetic particles is not more than 10 mg/L (Invention 1).

Also, according to the present invention, there are provided surface-treated rare earth-based magnetic particles as described in the above Invention 1, wherein the phosphoric acid compound forming the first coating layer is selected from the group consisting of orthophosphoric acid, disodium hydrogen phosphate, pyrophosphoric acid, metaphosphoric acid, manganese phosphate, zinc phosphate and aluminum phosphate (Invention 2).

Also, according to the present invention, there are provided surface-treated rare earth-based magnetic particles as described in the above Invention 1 or 2, wherein the composite coating film comprising the silicon compound and the phosphoric acid compound which forms the second coating layer comprises a compound produced from:

the phosphoric acid compound selected from the group consisting of orthophosphoric acid, disodium hydrogen phosphate, pyrophosphoric acid, metaphosphoric acid, manganese phosphate, zinc phosphate and aluminum phosphate, an alkoxy oligomer whose molecular end is capped with an alkoxysilyl group, and a silane coupling agent (Invention 3).

Also, according to the present invention, there are provided surface-treated rare earth-based magnetic particles as described in any one of the above Inventions 1 to 3, wherein a content of the phosphoric acid compounds in the surface-treated rare earth-based magnetic particles is 0.01 to 2.0% by weight (Invention 4).

Also, according to the present invention, there are provided surface-treated rare earth-based magnetic particles as described in any one of the above Inventions 1 to 4, wherein a content of Si in the surface-treated rare earth-based magnetic particles is 0.01 to 2.0% by weight (Invention 5).

Also, according to the present invention, there are provided surface-treated rare earth-based magnetic particles as described in any one of the above Inventions 1 to 5, wherein a content of carbon in the surface-treated rare earth-based magnetic particles is 0.01 to 2.0% by weight (Invention 6).

Also, according to the present invention, there are provided surface-treated rare earth-based magnetic particles as described in any one of the above Inventions 1 to 6, wherein the rare earth-based magnetic particles are Nd—Fe—B-based magnetic particles (Invention 7).

Also, according to the present invention, there are provided surface-treated rare earth-based magnetic particles as described in any one of the above Inventions 1 to 6, wherein the rare earth-based magnetic particles are Sm—Fe—N-based magnetic particles (Invention 8).

Further, according to the present invention, there is provided a resin composition for bonded magnets comprising the surface-treated rare earth-based magnetic particles as described in any one of the above Invention 1 to 8, and a resin (Invention 9).

In addition, according to the present invention, there is provided a bonded magnet comprising the surface-treated rare earth-based magnetic particles as described in any one of the above Inventions 1 to 8 (Invention 10).

Effect of the Invention

Since the surface-treated Nd—Fe—B-based magnetic particles or the surface-treated Sm—Fe—N-based magnetic particles according to the present invention are produced by coating the surface of the respective magnetic particles with a phosphoric acid compound and then forming a composite coating layer of a silicon compound and phosphoric acid on the thus obtained coating layer of the phosphoric acid compound, the bonded magnet produced using the surface-treated magnetic particles can be enhanced in rust prevention property. In this case, by varying the treatment conditions, it is possible to suitably control the thickness and adhering condition of the composite coating layer of the silicon compound and phosphoric acid which is adhered onto the respective magnetic particles.

The surface-treated Nd—Fe—B-based magnetic particles or the surface-treated Sm—Fe—N-based magnetic particles according to the present invention can exhibit a high rust prevention property and therefore can be used without suffering from formation of rusts even in severe conditions under which the conventional magnetic particles have been unusable. In particular, the bonded magnet produced using the surface-treated Nd—Fe—B-based magnetic particles according to the present invention together with a polyphenylene sulfide resin can be used even in more severe conditions than conventionally. Also, a resin-kneaded material comprising the surface-treated Sm—Fe—N-based magnetic particles can exhibit a high flowability, and therefore are advantageous for molding a bonded magnet having a fine complicated shape.

In addition, the heat treatments described in Patent Documents 4 and 5 are conducted at 230° C. under reduced pressure. On the other hand, in the present invention, the heat treatment can be most effectively conducted at 120° C. under an atmospheric pressure. Therefore, the process of the present invention needs no specific container nor specific facilities such as a moistening vapor source, resulting in low costs for facilities.

PREFERRED EMBODIMENTS OF THE INVENTION

Figure 1:
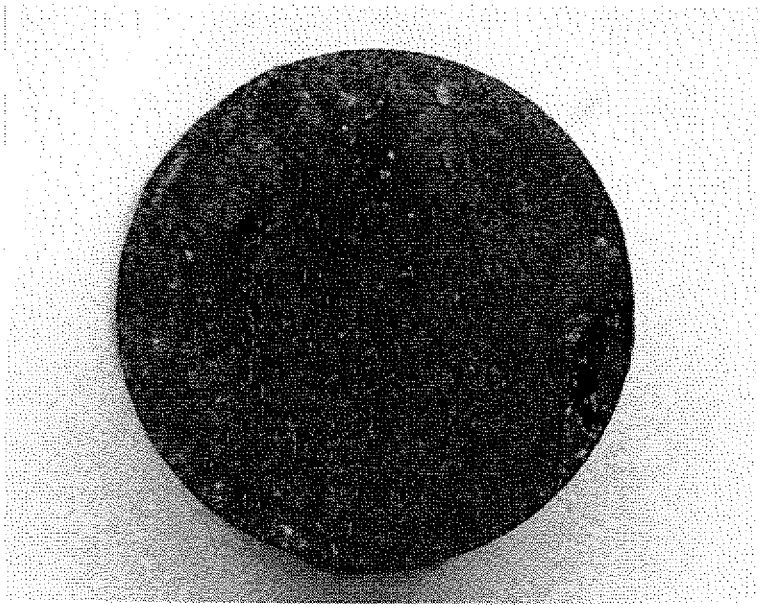
FIG. 1 shows the results of a rust prevention test of a bonded magnet obtained in Example 13.

The construction of the present invention is described in more detail below.

The surface-treated rare earth-based magnetic particles according to the present invention comprise Nd—Fe—B-based magnetic particles or Sm—Fe—N-based magnetic particles, a coating layer comprising a phosphoric acid compound which is formed on a surface of the respective Nd—Fe—B-based magnetic particles or Sm—Fe—N-based magnetic particles (first coating layer), and a coating layer in the form of a composite coating layer comprising a silicon compound and a phosphoric acid compound which is formed on a surface of the first coating layer (second coating layer). More preferably, the surface-treated rare earth-based magnetic particles comprise the Nd—Fe—B-based magnetic particles or Sm—Fe—N-based magnetic particles, the coating layer comprising a phosphoric acid compound which is formed on a surface of the respective Nd—Fe—B-based magnetic particles or Sm—Fe—N-based magnetic particles (first coating layer), the composite metal phosphoric acid salt coating layer comprising a silicon compound comprising silica derived from an alkoxy oligomer whose molecular end is capped with an alkoxysilyl group as a main component, and a phosphoric acid compound, which is formed on a surface of the first coating layer (second coating layer), and a surface-treating layer comprising a silane coupling agent which is formed on the composite metal phosphoric acid salt coating layer.

The silicon compound used for treating the Nd—Fe—B-based magnetic particles or the Sm—Fe—N-based magnetic particles in the present invention is such a silicon compound comprising silica as a main component which is produced by subjecting an alkoxy oligomer whose molecular end is capped with an alkoxysilyl group and a silane coupling agent to hydrolysis reaction under predetermined conditions.

The amount of Fe eluted from the surface-treated rare earth-based magnetic particles according to the present invention is not more than 10 mg/L (base on 1 L of water). When the amount of Fe eluted is more than 10 mg/L, there is a possibility that the phosphoric acid compound coating layer or the composite coating layer of the phosphoric acid and the silicon compound is insufficient in thickness or fails to be uniformly adhered, so that Fe tends to be eluted through these coating layers. The amount of Fe eluted from the surface-treated rare earth-based magnetic particles is preferably not more than 5.0 mg/L and more preferably not more than 2.5 mg/L. The lower limit of the amount of Fe eluted from the surface-treated rare earth-based magnetic particles is about 0.1 mg/L. Meanwhile, the method of measuring the amount of Fe eluted is described in the below-mentioned Examples.

The content of Si in the surface-treated rare earth-based magnetic particles according to the present invention is preferably 0.01 to 2.0% by weight. When the Si content is less than 0.01% by weight, the thickness of the composite coating layer of the phosphoric acid and the silicon compound which is formed on the surface of the phosphoric acid compound-coated magnetic particles tends to be insufficient, so that rusts tend to be caused owing to elution of Fe therefrom. On the contrary, when the Si content is more than 2.0% by weight, in particular, the Sm—Fe—N-based magnetic particles tend to suffer from remarkable deterioration in magnetic properties owing to increase in content of non-magnetic components per unit weight thereof. The Si content in the surface-treated rare earth-based magnetic particles is more preferably 0.05 to 1.0% by weight and still more preferably 0.06 to 0.8% by weight.

The total content of carbon in the surface-treated rare earth-based magnetic particles according to the present invention is preferably 0.01 to 2.0% by weight. When the total carbon content is less than 0.01% by weight, the amount of an organic functional group to be present on the surface of the respective magnetic particles when treated with the silane coupling agent tends to be extremely reduced, so that the magnetic particles tend to become poor in compatibility with resins, and the resulting resin composition tends to be deteriorated in flowability upon kneading and injection molding. In addition, since adhesion of the magnetic particles to resins tends to become low, the magnetic particles tend to have a resin-uncoated surface portion from which rusts are likely to be generated. The total carbon content in the surface-treated rare earth-based magnetic particles is more preferably 0.03 to 1.0% by weight and still more preferably 0.05 to 0.50% by weight.

The compressed density (CD) of the surface-treated rare earth-based magnetic particles according to the present invention is preferably not less than 4.1 g/cc. When the compressed density (CD) of the surface-treated rare earth-based magnetic particles is less than the above-specified range, the density per unit volume of the resulting resin composition upon injection molding tends to be lowered, resulting in deteriorated magnetic properties of the resulting injection-molded product. The upper limit of the compressed density (CD) of the surface-treated rare earth-based magnetic particles which are produced using the Nd—Fe—B-based magnetic particles is about 5.5 g/cc, whereas the upper limit of the compressed density (CD) of the surface-treated rare earth-based magnetic particles which are produced using the Sm—Fe—N-based magnetic particles is about 4.5 g/cc.

The BET specific surface area of the surface-treated rare earth-based magnetic particles according to the present invention which are produced using the Nd—Fe—B-based magnetic particles is preferably 0.01 to 3.5 $m^2/g$. When the BET specific surface area of the surface-treated rare earth-based magnetic particles which are produced using the Nd—Fe—B-based magnetic particles is out of the above-specified range, the magnetic particles tend to be inadequately pulverized, thereby failing to exhibit high magnetic properties. The BET specific surface area of the surface-treated rare earth-based magnetic particles which are produced using the Nd—Fe—B-based magnetic particles is more preferably 0.01 to 2.5 $m^2/g$.

The BET specific surface area of the surface-treated rare earth-based magnetic particles according to the present invention which are produced using the Sm—Fe—N-based magnetic particles is preferably 0.35 to 2.6 $m^2/g$. When the BET specific surface area of the surface-treated rare earth-based magnetic particles which are produced using the Sm—Fe—N-based magnetic particles is out of the above-specified range, the magnetic particles tend to be inadequately pulverized, thereby failing to exhibit high magnetic properties. The BET specific surface area of the surface-treated rare earth-based magnetic particles which are produced using the Sm—Fe—N-based magnetic particles is more preferably 0.35 to 2.0 $m^2/g$.

The rate of decrease in the BET specific surface area of the surface-treated rare earth-based magnetic particles according to the present invention (BET specific surface area after treated with the silane coupling agent/BET specific surface area before treated with the silane coupling agent) is preferably 5 to 80% as measured between before and after treated with the silane coupling agent. When the increase/decrease rate of the BET specific surface area is less than 5%, the thickness of the composite coating layer of the silicon compound and the phosphoric acid compound which is adhered onto the magnetic particles tends to be too small or non-uniform, so that Fe tends to be eluted from the resulting surface-treated magnetic particles. When the decrease rate of the BET specific surface area is more than 80%, the thickness of the coating layer of the silicon compound comprising silica as a main component which is adhered onto the magnetic particles tends to be too large, and the content of non-magnetic components per unit volume thereof tends to be lowered, so that it may be difficult to obtain desired properties of the resulting surface-treated magnetic particles. In particular, this phenomenon tends to be more remarkable in the case of using the Sm—Fe—N-based magnetic particles. The rate of decrease in the BET specific surface area of the surface-treated rare earth-based magnetic particles according to the present invention is more preferably 20 to 78%, still more preferably 35 to 75% and further still more preferably 40 to 70%.

The average particle diameter of the surface-treated rare earth-based magnetic particles according to the present invention which are produced using the Nd—Fe—B-based magnetic particles is preferably 10 to 100 μm and more preferably 40 to 80 μm, whereas the average particle diameter of the surface-treated rare earth-based magnetic particles according to the present invention which are produced using the Sm—Fe—N-based magnetic particles is preferably 1.0 to 5.0 μm and more preferably 1.0 to 4.0 μm.

The surface-treated rare earth-based magnetic particles according to the present invention which are produced using the Nd—Fe—B-based magnetic particles preferably have an $Nd_2Fe_{14}B$ type structure. Also, the surface-treated rare earth-based magnetic particles according to the present invention which are produced using the Sm—Fe—N-based magnetic particles preferably have an $Th_2Zn_{17}$ type structure.

The surface-treated rare earth-based magnetic particles according to the present invention which are produced using the Nd—Fe—B-based magnetic particles preferably have magnetic properties (as measured by orienting the particles in a magnetic field) including a coercive force of 478.6 to 2473 kA/m (6000 to 31000 Oe), a residual magnetic flux density of 1100 to 1500 mT (11 to 15 kG) and a maximum magnetic energy product of 199.1 to 557.4 $kJ/m^3$ (25 to 70 MGOe).

The surface-treated rare earth-based magnetic particles according to the present invention which are produced using the Sm—Fe—N-based magnetic particles preferably have magnetic properties (as measured by orienting the particles in a magnetic field) including a coercive force of 398.1 to 2387.3 kA/m (5000 to 30000 Oe), a residual magnetic flux density of 1000 to 1400 mT (10 to 14 kG) and a maximum magnetic energy product of 158.8 to 358.1 $kJ/m^3$ (20 to 45 MGOe).

Next, the process for producing the surface-treated rare earth-based magnetic particles according to the present invention is described.

The surface-treated rare earth-based magnetic particles according to the present invention can be produced by coating the Nd—Fe—B-based magnetic particles or the Sm—Fe—N-based magnetic particles with a phosphoric acid compound, and then adding a mixed solution prepared by mixing at least one alkoxy oligomer whose molecular end is capped with an alkoxysilyl group, with at least one phosphoric acid-based compound selected from the group consisting of orthophosphoric acid, disodium hydrogen phosphate, pyrophosphoric acid, metaphosphoric acid, manganese phosphate, zinc phosphate and aluminum phosphate to the coated Nd—Fe—B-based magnetic particles or Sm—Fe—N-based magnetic particles, followed by heat-treating the resulting particles, and thereafter subjecting the thus treated particles to coating treatment with a silane coupling agent.

The Nd—Fe—B-based magnetic particles to be surface-treated according to the present invention have a compressed density (CD) of not less than 4.1 g/cc, a BET specific surface area of 0.01 to 0.8 $m^2/g$ and an elution of Fe of 20 to 50 mg/L. Also, the Sm—Fe—N-based magnetic particles to be surface-treated according to the present invention have a BET specific surface area of 0.3 to 3 $m^2/g$ and an elution of Fe of 20 to 50 mg/L.

The starting alloy used for producing the Nd—Fe—B-based magnetic particles in the present invention may be prepared by any of known alloy production methods such as a book mold method, a centrifugal cast method, a strip cast method, an atomizing method and a reducing diffusion method.

The thus prepared Nd—Fe—B ingot may be subjected to homogenization treatment for the purposes of rendering crystal particles coarse and reducing an α-Fe phase. The homogenization treatment may be carried out, for example, in an inert gas atmosphere other than a nitrogen atmosphere, at a temperature of 1000 to 1200° C. for 1 to 48 hr.

When subjecting the Nd—Fe—B ingot to the homogenization treatment, elements in the Nd—Fe—B ingot are diffused, so that the respective components therein are homogenized. The Nd—Fe—B ingot comprises an $Nd_2Fe_{14}B$ phase as a main phase, an Nd-rich phase and a B-rich phase. In many of the Nd—Fe—B ingot, a ferromagnetic phase such as an $Nd_2Fe_{17}$ phase tends to be present in addition to the $Nd_2Fe_{14}$ phase. However, the Nd—Fe—B ingot comprising only the $Nd_2Fe_{14}B$ phase may be obtained by subjecting the ingot to heat treatment. When subjecting the Nd—Fe—B ingot to the homogenization treatment, the crystal particles thereof tend to become coarse so that the crystal particle size reaches about 100 μm or more. The formation of the coarse crystal particles having a large average crystal particle size is preferred because they exhibit a magnetic anisotropy.

The reason why nitrogen is not to be used as the inert gas atmosphere is that the Nd—Fe—B ingot tends to be undesirably reacted with nitrogen.

In addition, when the heat treatment temperature is lower than 1000° C., the diffusion of elements in the ingot tends to take a longer period of time, resulting in undesirable increase in production costs. When the heat treatment temperature is higher than 1200° C., the ingot tends to be undesirably melted.

After completion of the homogenization treatment, the Nd—Fe—B ingot may be pulverized by a known method including, for example, a mechanical pulverization method such as pulverization using a jaw crusher, a hydrogen absorbing pulverization method, or a pulverization method using a disk mill.

The Nd—Fe—B-based magnetic particles used in the present invention may be subjected to HDDR treatment. The HDDR treatment may be divided into a hydrogenation/disproportionation treatment (HD treatment) and a dehydrogenation/re-coupling treatment (DR treatment). The resulting Nd—Fe—B-based magnetic particles are charged into a vacuum horizontal sintering furnace and then subjected therein to the hydrogenation/disproportionation treatment (HD treatment) in a temperature range of 800 to 900° C. for 1 to 5 hr while flowing a hydrogen gas therethrough. Thereafter, the thus treated magnetic particles are subjected to the dehydrogenation/re-coupling treatment (DR treatment) in vacuum at the same temperature as used in the HD treatment. The HDDR treatment enables production of the Nd—Fe—B-based magnetic particles having an excellent magnetic anisotropy.

In the Sm—Fe—N-based magnetic particles to be surface-treated according to the present invention, it is preferred that the Sm/Fe atomic ratio near the surface of the respective magnetic particles is slightly larger than the Sm/Fe atomic ratio in a central portion of the respective magnetic particles. The Sm—Fe—N-based magnetic particles used in the present invention are produced by coating iron oxide particles with a hydrous samarium oxide such as samarium hydroxide, and then subjecting the thus coated particles to reducing reaction to reduce iron oxide into metallic iron. In this treatment, the samarium compound undergoes dehydration reaction and thereby transformed into samarium oxide. Thereafter, the samarium oxide is mixed with metallic calcium, and the resulting mixture is subjected to reducing diffusion reaction and then to nitridation reaction and further subjected to washing step to remove Ca therefrom and then dried, thereby obtaining the Sm—Fe—N-based magnetic particles which are slightly Sm-rich near the surface of the respective magnetic particles as compared to those having a composition of $Sm_2Fe_{17}$.

First, the coating treatment of the Nd—Fe—B-based magnetic particles or the Sm—Fe—N-based magnetic particles with the phosphoric acid compound is described.

Examples of the phosphoric acid compound include orthophosphoric acid, disodium hydrogen phosphate, pyrophosphoric acid, metaphosphoric acid, manganese phosphate, zinc phosphate and aluminum phosphate. Among these phosphoric acid compounds, orthophosphoric acid is preferred as the phosphoric acid compound to be adhered to the surface of the magnetic particles. Upon addition of the phosphoric acid compound, in order to uniformly coat the surface of the magnetic particles therewith, the phosphoric acid compound is preferably added in the form of a dilute solution prepared by mixing the phosphoric acid compound with isopropyl alcohol (IPA).

The phosphoric acid compound used in the present invention is preferably added in an amount of 0.1 to 5.0% by weight based on the weight of the Nd—Fe—B-based magnetic particles or the Sm—Fe—N-based magnetic particles. When the amount of the phosphoric acid compound added is less than 0.1% by weight, the thickness of the resulting coating layer of the phosphoric acid compound on the surface of the magnetic particles tends to be too small, thereby failing to attain desired effects. In addition, the uniform coating layer of the phosphoric acid compound tends to be hardly formed on the surface of the Nd—Fe—B-based magnetic particles or the Sm—Fe—N-based magnetic particles, so that Fe tends to be eluted therefrom. Further, even though the thickness of the composite coating layer of the silicon compound and the phosphoric acid compound which is subsequently surface-treated on the thus formed coating layer of the phosphoric acid compound is increased, adhesion between the magnetic particles and the composite coating layer of the silicon compound and the phosphoric acid compound tend to be deteriorated, so that Fe also tends to be eluted therefrom, resulting in promoted formation of rusts. On the contrary, when the amount of the phosphoric acid compound added is more than 5% by weight, the thickness of the coating layer of the phosphoric acid compound which is attached onto the surface of the magnetic particles tends to be too large, so that the content of the non-magnetic components therein per unit weight tends to be increased, so that the resulting particles tend to be undesirably deteriorated in magnetic properties. The deterioration of the magnetic properties owing to increase in content of the non-magnetic components tends to be caused more remarkably especially in the case of using the Sm—Fe—N-based magnetic particles. The amount of the phosphoric acid compound added is more preferably 0.1 to 4.0% by weight.

In the present invention, the surface-treating agent may be charged in the form of a mixed solution of the phosphoric acid compound such as orthophosphoric acid and IPA after deaggregating or pulverizing the Nd—Fe—B-based magnetic particles or the Sm—Fe—N-based magnetic particles.

The kinds of stirrers used in the above treatment is not particularly limited. However, there is preferably used a mixing type stirrer such as a universal stirrer. The heat treatment temperature is preferably 50 to 125° C. When the heat treatment temperature is lower than 50° C., the reaction tends to proceed too slowly, so that the formation of the phosphoric acid compound coating layer tends to take a long period of time, resulting in poor production efficiency. On the contrary, when the heat treatment temperature is higher than 120° C., the formation of the phosphoric acid compound coating layer tends to proceed excessively quickly, so that the uniform coating layer tends to be hardly formed. The heat treatment temperature is more preferably 80 to 125° C.

The heat treatment time is preferably 1 to 3 hr. When the heat treatment time is shorter than 1 hr, the surface of the Nd—Fe—B-based magnetic particles or the Sm—Fe—N-based magnetic particles tends to be hardly completely coated with the phosphoric acid compound. In addition, IPA tends to be insufficiently dried out. When the heat treatment time is longer than 3 hr, the reaction for formation of the phosphoric acid compound coating layer on the surface of the Nd—Fe—B-based magnetic particles or the Sm—Fe—N-based magnetic particles as well as drying of the coating layer tend to be already completed. Therefore, such a long heat treatment tends to be meaningless.

The atmosphere used upon the heat treatment in the present invention is preferably an inert gas atmosphere. However, the heat treatment may also be carried out in air.

Next, the coating treatment with the composite coating layer comprising the silicon compound derived from an alkoxy oligomer whose molecular end is capped with an alkoxysilyl group, and the phosphoric acid compound (formation of a second coating layer) is described.

In the present invention, there is used the alkoxy oligomer whose molecular end is capped with an alkoxysilyl group. Specific examples of the alkoxy group include an ethoxy group and a methoxy group. Among these alkoxy groups, preferred is an ethoxy group. The alkoxy oligomer is preferably added singly. However, the alkoxy oligomer may also be added in the form of a dilute solution prepared by diluting the oligomer with IPA, etc. Examples of the phosphoric acid compound include orthophosphoric acid, disodium hydrogen phosphate, pyrophosphoric acid, metaphosphoric acid, manganese phosphate, zinc phosphate and aluminum phosphate. Among these phosphoric acid compounds, preferred is orthophosphoric acid.

The amount of the alkoxy oligomer added whose molecular end is capped with an alkoxysilyl group as used in the present invention is preferably 0.1 to 2.0% by weight based on the weight of the Nd—Fe—B-based magnetic particles or the Sm—Fe—N-based magnetic particles. When the amount of the alkoxy oligomer added is less than 0.1% by weight, the thickness of the coating layer including the silicon compound comprising silica as a main component which is obtained after the surface treatment tends to be too small, so that even when subsequently treated with the silane coupling agent, the total thickness of the coating layers tends to be still insufficient, so that Fe tends to be eluted therefrom, resulting in formation of rusts. On the contrary, when the amount of the alkoxy oligomer added is more than 2.0% by weight, the thickness of the coating layer including the silicon compound comprising silica as a main component which is attached onto the surface of the magnetic particles tends to be too large, so that the content of the non-magnetic components per unit weight of the magnetic particles tends to be increased, resulting in undesirable deterioration in magnetic properties thereof. In particular, the Sm—Fe—N-based magnetic particles tend to more remarkably suffer from the deterioration in magnetic properties owing to the increased content of the non-magnetic components per unit weight of the magnetic particles. The amount of the alkoxy oligomer added is more preferably 0.2 to 1.8% by weight and still more preferably 0.4 to 1.5% by weight.

The amount of the phosphoric acid compound added for forming the composite coating layer of the silicon compound and the phosphoric acid compound is preferably 0.01 to 3.0% by weight based on the weight of the Nd—Fe—B-based magnetic particles or the Sm—Fe—N-based magnetic particles. When the amount of the phosphoric acid compound added for formation of the composite coating layer is less than 0.01% by weight, the composite coating layer comprising the silicon compound and the phosphoric acid compound tends to be incompletely formed, so that Fe tends to be readily eluted out therefrom, resulting in promoted formation of rusts. On the contrary, when the amount of the phosphoric acid compound added for formation of the composite coating layer is more than 3.0% by weight, the thickness of the coating layer including the phosphoric acid compound which is attached onto the magnetic particles tends to be too large, so that the content of the non-magnetic components per unit weight of the magnetic particles tends to be increased, resulting in undesirable deterioration in magnetic properties thereof. In particular, the Sm—Fe—N-based magnetic particles tend to more remarkably suffer from the deterioration in magnetic properties owing to the increased content of the non-magnetic components per unit weight of the magnetic particles. Further, the pH value of the treating solution tends to be increased, so that the surface of the magnetic particles tends to be hardly uniformly treated, and Fe tends to be therefore eluted out. The amount of the phosphoric acid compound added for formation of the composite coating layer is more preferably 0.1 to 2.0% by weight.

In the present invention, the time of preliminary mixing treatment to be conducted after adding the alkoxy oligomer whose molecular end is capped with an alkoxysilyl group, is 10 to 30 min.

The atmosphere used upon the preliminary mixing treatment is preferably an inert gas atmosphere. However, the preliminary mixing treatment may also be carried out in air. The preliminary mixing treatment is conducted without heating. When the preliminary mixing treatment is conducted at an elevated temperature, the reaction for formation of the composite coating layer comprising the silicon compound and the phosphoric acid compound tends to proceed rapidly before the treating solution for forming the composite coating layer is fully diffused over the Nd—Fe—B-based magnetic particles or the Sm—Fe—N-based magnetic particles, so that the Nd—Fe—B-based magnetic particles or the Sm—Fe—N-based magnetic particles may fail to be uniformly coated with the composite coating layer comprising the silicon compound and the phosphoric acid compound, resulting in elution of Fe therefrom.

The temperature used upon the above heat treatment is preferably 60 to 130° C. When the heat treatment temperature is lower than 60° C., the alkoxy oligomer tends to hardly undergo hydrolysis reaction, so that the composite coating layer comprising the silicon compound and the phosphoric acid compound tend to be hardly attached onto the magnetic particles. On the contrary, when the heat treatment temperature is higher than 130° C., the hydrolysis reaction tends to proceed too rapidly, so that the surface of the magnetic particles may fail to be uniformly coated with the composite coating layer comprising the silicon compound and the phosphoric acid compound, resulting in unevenness of the composite coating layer adhered. The heat treatment temperature is more preferably 80 to 130° C.

The time required for the heat treatment is preferably 2 to 6 hr. When the heat treatment time is shorter than 2 hr, the reaction tends to proceed insufficiently, so that the composite coating layer comprising the silicon compound and the phosphoric acid compound may fail to be sufficiently adhered onto the surface of the magnetic particles. On the other hand, when the heat treatment time is longer than 6 hr, a sufficient amount of the composite coating layer comprising the silicon compound and the phosphoric acid compound is already adhered onto the surface of the magnetic particles, and therefore such a long heat treatment time tends to be meaningless.

The amount of Fe eluted from the Nd—Fe—B-based magnetic particles or the Sm—Fe—N-based magnetic particles which are coated with the composite metal phosphoric acid salt coating layer comprising the silicon compound and the phosphoric acid compound according to the present invention is preferably not more than 15 mg/L. When the amount of Fe eluted is out of the above-specified range, even in the case where the treatment with the coupling agent is conducted after completion of the treatment with the composite coating layer, the elution of Fe tends to be hardly suppressed, thereby failing to sufficiently attain the aimed effects of the present invention. The amount of Fe eluted from the Nd—Fe—B-based magnetic particles or Sm—Fe—N-based magnetic particles which are coated with the composite coating layer is more preferably not more than 10 mg/L.

The compressed density (CD) of the Nd—Fe—B-based magnetic particles which are coated with the composite metal phosphoric acid salt coating layer comprising the silicon compound and the phosphoric acid compound according to the present invention is preferably not less than 4.5 g/cc. When the compressed density (CD) is out of the above-specified range, the density of the magnetic particles in the resulting resin composition per unit volume thereof upon injection molding tends to be lowered, resulting in poor magnetic properties of the resulting molded product. The compressed density (CD) of the Nd—Fe—B-based magnetic particles which are coated with the composite metal phosphoric acid salt coating layer is more preferably 4.5 to 5.1 g/cc. Whereas, the compressed density (CD) of the Sm—Fe—N-based magnetic particles which are coated with the composite metal phosphoric acid salt coating layer comprising the silicon compound and the phosphoric acid compound according to the present invention is preferably not less than 4.2 g/cc. When the compressed density (CD) is out of the above-specified range, the density of the magnetic particles in the resulting resin composition per unit volume thereof upon injection molding tends to be lowered, resulting in poor magnetic properties of the resulting molded product. The compressed density (CD) of the Sm—Fe—N-based magnetic particles which are coated with the composite metal phosphoric acid salt coating layer is more preferably 4.2 to 4.8 g/cc.

The BET specific surface area of the Nd—Fe—B-based magnetic particles which are coated with the composite metal phosphoric acid salt coating layer comprising the silicon compound and the phosphoric acid compound according to the present invention is preferably 0.1 to 5.0 $m^2/g$. When the BET specific surface area is out of the above-specified range, no adequate coating treatment tends to be carried out, so that the resulting surface-treated magnetic particles may fail to exhibit the desired rust prevention property. The BET specific surface area of the Nd—Fe—B-based magnetic particles which are coated with the composite metal phosphoric acid salt coating layer is more preferably 0.15 to 4.5 $m^2/g$.

Next, the coating treatment with the silane coupling agent is described.

In the present invention, after completion of the above surface treatment for forming the composite metal phosphoric acid salt coating layer comprising the silicon compound and the phosphoric acid compound, the resulting coated magnetic particles are further subjected to surface treatment with the silane coupling agent.

Examples of the silane coupling agent used in the present invention include γ-(2-aminoethyl)aminopropyl trimethoxysilane, γ-(2-aminoethyl)aminopropylmethyl dimethoxysilane, γ-methacryloxypropyl trimethoxysilane, γ-methacryloxypropylmethyl dimethoxysilane, N-β-(N-vinylbenzylaminoethyl)-γ-aminopropyl trimethoxysilane hydrochloride, γ-glycidoxypropyl trimethoxysilane, γ-mercaptopropyl trimethoxysilane, methyl trimethoxysilane, methyl triethoxysilane, vinyl triacetoxysilane, γ-chloropropyl trimethoxysilane, hexamethylene disilazane, γ-anilinopropyl trimethoxysilane, vinyl trimethoxysilane, octadecyl [3-(trimethoxysilyl)propyl]ammonium chloride, γ-chloropropylmethyl dimethoxysilane, γ-mercaptopropylmethyl dimethoxysilane, methyl trichlorosilane, dimethyl dichlorosilane, trimethyl chlorosilane, vinyl trichlorosilane, vinyl tris(p-methoxyethoxy)silane, vinyl triethoxysilane, β-(3,4-epoxycyclohexyl)ethyl trimethoxysilane, γ-glycidoxypropylmethyl dimethoxysilane, N-β-(aminoethyl) γ-aminopropyl trimethoxysilane, N-β-(aminoethyl) γ-aminopropylmethyl dimethoxysilane, γ-aminopropyl triethoxysilane, N-phenyl-γ-aminopropyl trimethoxysilane, oleydpropyl triethoxysilane, γ-isocyanatopropyl triethoxysilane, polyethoxydimethyl siloxane, polyethoxymethyl siloxane, bis(trimethoxysilylpropyl)amine, bis(3-triethoxysilylpropyl)tetrasulfane, γ-isocyanatopropyl trimethoxysilane, vinylmethyl dimethoxysilane, 1,3,5-N-tris(3-trimethoxysilylpropyl)isocyanurate, t-butyl carbamate trialkoxysilane, γ-glycidoxypropyl triethoxysilane, γ-methacryloxypropylmethyl diethoxysilane, γ-methacryloxypropyl triethoxysilane, N-β-(aminoethyl) γ-aminopropyl triethoxysilane, and 3-acryloxypropyl trimethoxysilane N-(1,3-dimethylbutylidene)-3-(triethoxysilyl)-1-propane amine.

The silane coupling agent may also be used in the form of a dilute solution prepared by diluting the silane coupling agent with water, IPA, etc.

The surface treatment with the silane coupling agent may be conducted by an ordinary method. In the present invention, the surface treatment is preferably carried out by mixing and stirring, and at the same time by heating.

The atmosphere used upon the heat treatment is preferably an inert gas atmosphere such as a nitrogen gas or an argon gas. The heat treatment temperature is preferably 85 to 150° C. When the heat treatment temperature is lower than 85° C., IPA used for diluting the silane coupling agent tends to be hardly vaporized, and remain on the surface of the magnetic particles, so that the resulting magnetic particles tend to have a poor compatibility with resins upon kneading therewith. On the contrary, when the heat treatment temperature is higher than 150° C., the reaction of the silane coupling agent is already completed so that the silane compound comprising silica as a main component is fully attached onto the magnetic particles, and therefore the use of such a high heat treatment temperature is meaningless. In addition, under the high temperature condition, the organic functional group being present on the surface of the thus coated magnetic particles tends to be deteriorated by heat, so that the compatibility of the magnetic particles with resins tends to become poor, resulting in deterioration in strength of the resulting bonded magnet.

Next, the resin composition for bonded magnets according to the present invention is described.

The resin composition for bonded magnets according to the present invention comprises the surface-treated Nd—Fe—B-based magnetic particles or Sm—Fe—N-based magnetic particles and a binder resin in which the surface-treated magnetic particles are dispersed. Specifically, the resin composition for bonded magnets according to the present invention comprises the surface-treated Nd—Fe—B-based magnetic particles or Sm—Fe—N-based magnetic particles in an amount of 86 to 99% by weight, and the balance comprising the binder resin and other additives.

The binder resin may be selected from various resins according to a molding method used. In the case of using an injection molding method, an extrusion molding method and a calendering method, thermoplastic resins may be suitably used as the binder resin. In the case of using a compression molding method, thermosetting resins may be suitably used as the binder resin. Examples of the thermoplastic resins usable in the present invention include nylon (PA)-based resins, polypropylene (PP)-based resins, ethylene vinyl acetate (EVA)-based resins, polyphenylene sulfide (PPS)-based resins, liquid crystal resins (LCP), elastomer-based resins, rubber-based resins, etc. Examples of the thermosetting resins usable in the present invention include epoxy-based resins and phenol-based resins.

Meanwhile, upon production of the resin composition for bonded magnets, in order to improve a flowability and a moldability thereof and allow the Nd—Fe—B-based magnetic particles or Sm—Fe—N-based magnetic particles to sufficiently exhibit magnetic properties thereof, in addition to the binder resin, there may be used known additives such as a plasticizer, a lubricant and a coupling agent, if required. In addition, the other kinds of magnet particles such as ferrite magnet particles may also be mixed in the resin composition.

These additives may be adequately selected according to the aimed applications and objects. As the plasticizer, there may be used commercially available products according to the respective resins used. The total content of the plasticizers used in the resin composition is about 0.01 to 5.0% by weight based on the weight of the binder resin.

Examples of the lubricant usable in the present invention include stearic acid and derivatives thereof, inorganic lubricants, oil-based lubricants, etc. The lubricant may be used in an amount of 0.01 to 1.0% by weight based on the total weight of the bonded magnet.

As the coupling agent, there may be used commercially available products according to the resins and fillers used. The coupling agent may be used in an amount of about 0.01 to 3.0% by weight based on the weight of the binder resin used.

Examples of the other magnetic particles usable in the present invention include ferrite magnet particles, alnico-based magnet particles and rare earth-based magnet particles, etc.

The flow property (MFR) of the resin composition for bonded magnets comprising the Nd—Fe—B-based magnetic particles or Sm—Fe—N-based magnetic particles is desirably about 10 to 500 g/10 min as measured by the below-mentioned evaluation method. When the flow property of the resin composition is less than 10 g/10 min, the resin composition tends to be considerably deteriorated in injection moldability and productivity.

The resin composition for bonded magnets according to the present invention is obtained by mixing and kneading the Nd—Fe—B-based magnetic particles or Sm—Fe—N-based magnetic particles with the binder resin.

The above mixing may be conducted using a mixer such as a Henschel mixer, a V-shaped mixer and a Nauter mixer, whereas the above kneading may be conducted using a single screw kneader, a twin screw kneader, a mill-type kneader, an extrusion kneader, etc.

Next, the bonded magnet according to the present invention is described.

The magnetic properties of the bonded magnet may vary according to the applications thereof as aimed. The bonded magnet preferably has a residual magnetic flux density of 350 to 850 mT (3.5 to 9.0 kG), a coercive force of 238.7 to 1428.5 kA/m (3000 to 18000 Oe) and a maximum energy product of 23.9 to 198.9 kJ/m$^3$ (3 to 25 MGOe).

The molded density of the bonded magnet is preferably 4.5 to 5.5 g/cm$^3$.

The bonded magnet of the present invention may be produced by subjecting the above resin composition for bonded magnets to a known molding method such as injection molding, extrusion molding, compression molding and calendaring, and then subjecting the resulting molded product to electromagnet magnetization or pulse magnetization by an ordinary method.

<Function>

The surface-treated Nd—Fe—B-based magnetic particles or Sm—Fe—N-based magnetic particles according to the present invention exhibit a less elution of Fe therefrom.

The reason why the magnetic particles whose surface is coated with the phosphoric acid compound and then with the composite coating layer of the silicon compound and the phosphoric acid compound and further treated with the silane coupling agent are enhanced in rust prevention property as compared to those particles whose surface is coated with the phosphoric acid compound and then with the silicon compound solely and further treated with the silane coupling agent, is considered as follows, although not clearly determined. That is, it is considered that the composite coating layer comprising the silicon compound and the phosphoric acid compound exhibits a high adhesion property. In addition, it is considered that since the phosphoric acid is present during the reaction step for obtaining the silicon compound, the dense coating layer is formed around the phosphoric acid compound as a core, so that the barrier effect of the coating layer is enhanced synergistically and penetration of corrosive ions therethrough can be effectively suppressed.

In the present invention, since the surface of the respective Nd—Fe—B-based magnetic particles or Sm—Fe—N-based magnetic particles is coated with the phosphoric acid compound and further the surface of the phosphoric acid compound coating layer is coated with both the silicon compound and the phosphoric acid compound, the resin composition using the magnetic particles can exhibit a high flowability, and the bonded magnet produced by molding the resin composition can exhibit an excellent rust prevention property.

EXAMPLES

Next, the present invention is described in more detail by referring to Examples and Comparative Examples. However, these Examples are only illustrative and not intended to limit the present invention thereto.

The average particle diameter of the Nd—Fe—B-based magnetic particles or Sm—Fe—N-based magnetic particles was measured using "HELOS".

The specific surface area of the Nd—Fe—B-based magnetic particles or Sm—Fe—N-based magnetic particles was measured by a BET method.

The contents of P and Si were respectively calculated from the values as measured by X-F (fluorescent X-ray analysis) or compositional analysis by ICP.

The compressed density of the particles was determined from the value as measured when compressing a sample by applying a pressure of 1 t/cm$^2$ thereto.

The carbon content was measured using a carbon and sulfur measuring apparatus "EMIA-820W" manufactured by Horiba Seisakusho Co., Ltd.

The amount of iron eluted from the particles was measured as follows. That is, 1.0 g of a sample was dipped in 50 mL of pure water in which 0.05 g of catechol was dissolved, and the obtained mixture was allowed to stand at room temperature (30° C.) for 24 hr and then filtered to obtain a filtrate. The thus obtained filtrate was analyzed using an ICP emission spectroscopic apparatus. In the above measurement, catechol serves to stabilize Fe eluted from the sample by forming a complex of Fe therewith to thereby enable accurate measurement of the amount of Fe eluted from the sample.

The magnetic properties of the Nd—Fe—B-based magnetic particles or Sm—Fe—N-based magnetic particles were measured as follow. That is, the magnetic particles to be measured were filled together with a wax in a capsule, and heated and cooled while applying an orientation magnetic field thereto. The magnetic properties of the thus magnetically oriented magnetic particles were expressed by the values measured using a vibration sample magnetometer "VSM" manufactured by Toei Kogyo Co., Ltd.

The flow property (MFR) of the resin composition for bonded magnets was measured as follow. That is, as to the resin composition produced using the Nd—Fe—B-based magnetic particles, 88.81 parts by weight of the Nd—Fe—B-based magnetic particles and 8.91 parts by weight of polyphenylene sulfide were mixed with each other using a Henschel mixer, and then kneaded using a twin-screw extrusion kneader (kneading temperature: 300° C.). The flow property (MFR) of the obtained kneaded composition was measured at a heating temperature of 330° C. by applying a pressure of 5 kgf thereto using a semi-automatic melt indexer "Model 2A" manufactured by Toyo Seiki Co., Ltd. Also, as to the resin composition produced using the Sm—Fe—N-based magnetic particles, 91.64 parts by weight of the Sm—Fe—N-based magnetic particles, 7.3 parts by weight of 12 nylon, 0.5 part by weight of an antioxidant and 1.0 part by weight of a surface-treating agent were mixed with each other using a Henschel mixer, and then kneaded using a twin-screw extrusion kneader (kneading temperature: 190° C.). The flow property (MFR) of the obtained kneaded composition was measured at a heating temperature of 270° C. by applying a pressure of 10 kgf thereto using a semi-automatic melt indexer "Model 2A" manufactured by Toyo Seiki Co., Ltd.

The magnetic properties of the bonded magnet which had been molded in an orientation magnetic field were measured using a BH tracer manufactured by Toei Kogyo Co., Ltd.

The rust prevention property of the bonded magnet was measured as follows. That is, the obtained bonded magnet having a size of 10ϕ×7 mm was evaluated using a highly corrosive test solution as described in ASTM D1384. The degrees of formation of rusts on the bonded magnet as measured by dipping the bonded magnet in the test solution at 95° C. for 100 hr were compared, and evaluated according to the ratings (◎, ○, Δ and X) as prescribed in "Corrosion Test Method for Bonded Magnets" in "Guide Book of Testing Methods for Bonded Magnets" published by The Japan Associate of Bonded Magnet Industries. In order to more clearly determine the degree of formation of rusts, the surface of the bonded magnet was filed before being dipped in the test solution to remove a skin layer on the surface of the bonded magnet for facilitating corrosion thereof.

[Precursor 1]

<Starting Alloy>

The Nd—Fe—B ingot was prepared by a book mold method. The thus prepared ingot was pulverized into a lattice shape having a thickness of 20 mm and each side length of about 50 mm.

<Homogenization Treatment>

The Nd—Fe—B ingot thus prepared by a book mold method was subjected to soaking treatment for the purpose of forming coarse crystal particles and reducing an α-Fe phase therein. The soaking treatment was carried out in an inert gas (argon gas) atmosphere at 1150° C. for 20 hr to obtain the aimed Nd—Fe—B ingot.

<Pulverization>

The Nd—Fe—B ingot after subjected to the soaking treatment was pulverized using a jaw crusher to obtain Nd—Fe—B particles.

<HDDR Treatment>

The thus obtained Nd—Fe—B-based magnetic particles were charged into a vacuum horizontal sintering furnace, and the temperature within the sintering furnace was changed stepwise in the range of 800 to 900° C. while flowing a hydrogen gas therethrough at a rate of 15 L/min to thereby subject the magnetic particles to hydrogenation/disproportionation treatment (HD treatment) for a period of about 5 hr in total. Thereafter, the magnetic particles were subjected to dehydrogenation/re-coupling treatment (DR treatment) in vacuum at the same temperature as used in the HD treatment, thereby obtaining Nd—Fe—B-based magnetic particles having an excellent magnetic anisotropy.

As a result, it was confirmed that the thus obtained Nd—Fe—B-based magnetic particles had a BET specific surface area of 0.04 m$^2$/g, a compressed density (CD) of 4.84 g/cc and an elution of Fe of 20.25 mg/L, and the magnetic properties of the Nd—Fe—B-based magnetic particles were a coercive force of 1135 kA/m (14230 Oe) and a maximum energy product of 251.87 kJ/m$^3$ (31.63 MGOe) (the resulting Nd—Fe—B-based magnetic particles are hereinafter referred to "sample A").

<Surface Treatment>

A universal stirrer was charged with 1500 g of the obtained Nd—Fe—B-based magnetic particles. Then, a mixed solution prepared from 3.75 g of orthophosphoric acid (0.25% by weight based on the magnetic particles) and 18.75 g of IPA (1.25% by weight based on the magnetic particles) was directly added to the Nd—Fe—B-based magnetic particles, and mixed therewith in air for 10 min. Thereafter, the obtained mixture was heat-treated at 80° C. for 1 hr and then at 120° C. for 2.5 hr in air under an atmospheric pressure while stirring, thereby obtaining the Nd—Fe—B-based magnetic particles whose surface was coated with the phosphoric acid compound coating layer.

[Precursor 2]

The same treatment as defined in the above "Precursor 1" was conducted except that a mixed solution prepared from 7.5 g of orthophosphoric acid (0.5% by weight based on the magnetic particles) and 37.5 g of IPA (2.5% by weight based on the magnetic particles) was used, thereby obtaining the Nd—Fe—B-based magnetic particles whose surface was coated with the phosphoric acid compound coating layer.

[Precursor 3]

The same treatment as defined in the above "Precursor 1" was conducted except that a mixed solution prepared from 11.25 g of orthophosphoric acid (0.75% by weight based on the magnetic particles) and 57.0 g of IPA (3.8% by weight based on the magnetic particles) was used, thereby obtaining the Nd—Fe—B-based magnetic particles whose surface was coated with the phosphoric acid compound coating layer.

[Precursor 4]

A universal stirrer was charged with 1500 g of the Nd—Fe—B-based magnetic particles as produced. Then, a mixed solution prepared from 7.5 g of orthophosphoric acid (0.5% by weight based on the magnetic particles) and 37.5 g of IPA (2.5% by weight based on the magnetic particles) was directly added to the Nd—Fe—B-based magnetic particles, and mixed therewith in air for 10 min. Thereafter, the obtained mixture was heat-treated at 80° C. for 1 hr in air under an atmospheric pressure while stirring, thereby obtaining the Nd—Fe—B-based magnetic particles whose surface was coated with the phosphoric acid compound coating layer.

[Precursor 5]

A universal stirrer was charged with 1500 g of the Nd—Fe—B-based magnetic particles as produced. Then, a mixed solution prepared from 7.5 g of orthophosphoric acid (0.5% by weight based on the magnetic particles) and 37.5 g of IPA (2.5% by weight based on the magnetic particles) was directly added to the Nd—Fe—B-based magnetic particles, and mixed therewith in air for 10 min. Thereafter, the obtained mixture was heat-treated at 80° C. for 1 hr and then at 100° C. for 2.5 hr in air under an atmospheric pressure while stirring, thereby obtaining the Nd—Fe—B-based magnetic particles whose surface was coated with the phosphoric acid compound coating layer.

[Precursor 6]

A universal stirrer was charged with 1500 g of the Nd—Fe—B-based magnetic particles as produced. Then, a mixed solution prepared from 7.5 g of orthophosphoric acid (0.5% by weight based on the magnetic particles) and 37.5 g of IPA (2.5% by weight based on the magnetic particles) was directly added to the Nd—Fe—B-based magnetic particles, and mixed therewith in air for 10 min. Thereafter, the obtained mixture was heat-treated at 80° C. for 1 hr and then at 150° C. for 2.5 hr in air under an atmospheric pressure while stirring, thereby obtaining the Nd—Fe—B-based magnetic particles whose surface was coated with the phosphoric acid compound coating layer.

[Precursor 7]

<Production of Samarium Compound-Coated Iron Oxide Particles>

A reactor was charged with given amounts of water, sodium hydroxide and a ferrous sulfate solution, and the contents of the reactor were maintained at 90° C. and subjected to oxidation reaction while blowing air thereinto to thereby obtain magnetite particles. As a result, it was confirmed that the resulting magnetite particles had an average particle diameter of 0.70 μm, a standard deviation of the particles diameters of 0.11 μm and a particle size distribution of 15%.

Into the resulting slurry comprising the magnetite particles was added a samarium chloride solution comprising a samarium atom in an amount of 11.76 mol %. Then, the pH value of the slurry was adjusted to 13 to subject the slurry to aging reaction for 2 hr while maintaining the temperature of the slurry at 90° C. Thereafter, the slurry was subjected to filtration and water-washing to remove soluble salts therefrom, and then dried, thereby obtaining samarium compound-coated magnetite particles.

<Reducing Reaction and Stabilization Treatment>

Next, the thus obtained samarium compound-coated magnetite particles were charged into a rotary heat treatment furnace, and heated at 800° C. over 7 hr while flowing a hydrogen gas having a purity of 99.99% therethrough at a rate of 40 L/min to thereby conduct a reducing reaction thereof. The product obtained after completion of the reducing reaction was in the form of a mixture of iron particles and samarium oxide particles. Then, the atmosphere in the rotary furnace was replaced with $N_2$, and the temperature therein was dropped to 40° C. by cooling. After the temperature was stably held, the mixture was subjected to stabilization treatment while flowing $N_2$ comprising about 2.0% by volume of oxygen therethrough to gradually oxidize the surface of the respective iron particles and thereby form an oxide coating layer thereon. The heat of reaction was monitored, and when generation of the heat of reaction was ceased, the whole reaction system was cooled to room temperature to withdraw the obtained mixture from the furnace into atmospheric air.

<Reducing Diffusion Reaction>

The thus obtained samarium oxide-coated iron particles and metallic Ca particles (in an amount of 3.0 mol per 1.0 mol of Sm in the samarium oxide-coated iron particles) were mixed with each other. The resulting mixture was placed on a pure iron tray, and inserted into an atmospheric furnace. After the inside of the furnace was evacuated, the atmosphere within the furnace was replaced with an argon atmosphere. Then, the inside temperature of the furnace was raised to 1050° C. while flowing an argon gas therethrough at which temperature the reaction system was maintained for 30 min to subject the contents of the furnace to reducing diffusion reaction. After completion of the reaction, the reaction system was cooled to 300° C.

<Nitridation Reaction>

After the furnace temperature was stabilized at 300° C., the inside of the furnace was once evacuated, and the atmosphere within the furnace was replaced with an $N_2$ gas atmosphere. Next, the furnace temperature was raised to 420° C. under an $N_2$ gas flow, and held at the same temperature for 8 hr to subject the contents of the furnace to nitridation reaction. After completion of the reaction, the reaction system was cooled to room temperature.

The Sm—Fe—N-based magnetic particles before subjected to the below-mentioned phosphoric acid treatment used for production of the precursor 7 had an average particle diameter of 3.33 μm, a BET specific surface area of 1.66 $m^2/g$, a compressed density (CD) of 4.07 g/cc, an oil absorption of 13.4 g/cc and an elution of Fe of 35.2 mg/L, and the magnetic properties of the Sm—Fe—N-based magnetic particles were a coercive force of 1235 kA/m (15520 Oe), a residual magnetic flux density of 1120 mT (11.2 kG) and a maximum energy product of 223.3 $kJ/m^3$ (28.074 MGOe) (the resulting Sm—Fe—N-based magnetic particles were hereinafter referred to a "sample B").

<Water-Washing and Pulverization>

The particles obtained after the nitridation reaction were charged into water to prepare a slurry. At this time, the particles underwent spontaneous degradation to thereby begin separation of the particles into the Sm—Fe—N-based magnetic particles and the Ca component. After the Sm—Fe—N-based magnetic particles and the Ca component were fully separated from each other, the slurry was repeatedly subjected to decantation and water-washing to remove the Ca component therefrom. Next, the thus water-washed slurry was subjected to pulverization in the state comprising water as a solvent, and insoluble components generated upon the pulverization were removed by subjecting the slurry to decantation and water-washing.

<Filtration, Surface Treatment and Drying>

Next, the resulting slurry was subjected to filtration to remove water therefrom. The filtration was carried out such that a water content of the filtered product was 25% by weight, thereby obtaining a filter cake. The thus obtained filter cake was dried at 60° C. while stirring in a nitrogen flow under reduced pressure using a stirrer of an evacuating type.

Thereafter, a universal stirrer was charged with 1500 g of the thus dried magnetic particles. Then, a mixed solution prepared from 7.5 g of orthophosphoric acid (0.5% by weight based on the magnetic particles) and 37.5 g of IPA (2.5% by weight based on the magnetic particles) was directly added to the Sm—Fe—N-based magnetic particles, and mixed therewith in air for 10 min. Thereafter, the obtained mixture was heat-treated at 80° C. for 1 hr and then at 120° C. for 2.5 hr in an inert gas atmosphere while stirring, thereby obtaining the Sm—Fe—N-based magnetic particles whose surface was coated with the phosphoric acid compound coating layer.

The thus obtained Sm—Fe—N-based magnetic particles (precursor 7) had a total phosphorus content of about 0.15% by weight.

[Precursor 8]

A universal stirrer was charged with 1500 g of the Nd—Fe—B-based magnetic particles obtained in the above "Precursor 2". Then, 10.5 g of an alkoxy oligomer whose molecular end was capped with an alkoxysilyl group (treating agent 1) (0.7% by weight based on the Nd—Fe—B-based magnetic particles), 4.5 g of orthophosphoric acid (treating agent 2) (0.3% by weight based on the Nd—Fe—B-based magnetic particles) and 3.9 g of pure water (0.26% by weight based on the Nd—Fe—B-based magnetic particles) were respectively weighed and then mixed with 37.5 g of a diluting solution (2.5% by weight based on the Nd—Fe—B-based magnetic particles). Thereafter, the obtained treating agent mixture was directly added to the Nd—Fe—B-based magnetic particles, and then mixed therewith in air for 10 min. After completion of the addition, the obtained mixture was heat-treated at 60° C. for 2.5 hr in air under an atmospheric pressure while stirring, thereby obtaining Nd—Fe—B-based magnetic particles whose surface was coated with a composite coating layer comprising the silicon compound and the phosphoric acid compound.

[Precursor 9]

A universal stirrer was charged with 1500 g of the Nd—Fe—B-based magnetic particles obtained in the above "Precursor 2". Then, 10.5 g of an alkoxy oligomer whose molecular end was capped with an alkoxysilyl group (0.7% by weight based on the Nd—Fe—B-based magnetic particles), 4.5 g of orthophosphoric acid (0.3% by weight based on the Nd—Fe—B-based magnetic particles) and 3.9 g of pure water (0.26% by weight based on the Nd—Fe—B-based magnetic particles) were respectively weighed and then mixed with 37.5 g of a diluting solution (2.5% by weight based on the Nd—Fe—B-based magnetic particles). Thereafter, the obtained treating agent mixture was directly added to the Nd—Fe—B-based magnetic particles, and then mixed therewith in air for 10 min. After completion of the addition, the obtained mixture was heat-treated at 80° C. for 1 hr and then at 120° C. for 2.5 hr in air under an atmospheric pressure while stirring, thereby obtaining Nd—Fe—B-based magnetic particles whose surface was coated with a composite coating layer comprising the silicon compound and the phosphoric acid compound.

[Precursor 10]

A universal stirrer was charged with 1500 g of the Nd—Fe—B-based magnetic particles obtained in the above "Precursor 2". Then, 10.5 g of an alkoxy oligomer whose molecular end was capped with an alkoxysilyl group (0.7% by weight based on the Nd—Fe—B-based magnetic particles), 4.5 g of orthophosphoric acid (0.3% by weight based on the Nd—Fe—B-based magnetic particles) and 3.9 g of pure water (0.26% by weight based on the Nd—Fe—B-based magnetic particles) were respectively weighed and then mixed with 37.5 g of a diluting solution (2.5% by weight based on the Nd—Fe—B-based magnetic particles). Thereafter, the obtained treating agent mixture was directly added to the Nd—Fe—B-based magnetic particles, and then mixed therewith in air for 10 min. After completion of the addition, the obtained mixture was heat-treated at 80° C. for 1 hr and then at 180° C. for 2.5 hr in air under an atmospheric pressure while stirring, thereby obtaining Nd—Fe—B-based magnetic particles whose surface was coated with a composite coating layer comprising the silicon compound and the phosphoric acid compound.

[Precursor 11]

A universal stirrer was charged with 1500 g of the Nd—Fe—B-based magnetic particles obtained in the above "Precursor 2". Then, 5.25 g of an alkoxy oligomer whose molecular end was capped with an alkoxysilyl group (0.35% by weight based on the Nd—Fe—B-based magnetic particles), 2.25 g of orthophosphoric acid (0.15% by weight based on the Nd—Fe—B-based magnetic particles) and 2.25 g of pure water (0.15% by weight based on the Nd—Fe—B-based magnetic particles) were respectively weighed and then mixed with 18.75 g of a diluting solution (1.25% by weight based on the Nd—Fe—B-based magnetic particles). Thereafter, the obtained treating agent mixture was directly added to the Nd—Fe—B-based magnetic particles, and then mixed therewith in air for 10 min. After completion of the addition, the obtained mixture was heat-treated at 80° C. for 1 hr and then at 120° C. for 2.5 hr in air under an atmospheric pressure while stirring, thereby obtaining Nd—Fe—B-based magnetic particles whose surface was coated with a composite coating layer comprising the silicon compound and the phosphoric acid compound.

[Precursor 12]

A universal stirrer was charged with 1500 g of the Nd—Fe—B-based magnetic particles obtained in the above "Precursor 2". Then, 15.75 g of an alkoxy oligomer whose molecular end was capped with an alkoxysilyl group (1.05% by weight based on the Nd—Fe—B-based magnetic particles), 6.75 g of orthophosphoric acid (0.45% by weight based on the Nd—Fe—B-based magnetic particles) and 6.75 g of pure water (0.45% by weight based on the Nd—Fe—B-based magnetic particles) were respectively weighed and then mixed with 56.25 g of a diluting solution (3.75% by weight based on the Nd—Fe—B-based magnetic particles). Thereafter, the obtained treating agent mixture was directly added to the Nd—Fe—B-based magnetic particles, and then mixed therewith in air for 10 min. After completion of the addition, the obtained mixture was heat-treated at 80° C. for 1 hr and then at 120° C. for 2.5 hr in air under an atmospheric pressure while stirring, thereby obtaining Nd—Fe—B-based magnetic particles whose surface was coated with a composite coating layer comprising the silicon compound and the phosphoric acid compound.

[Precursor 13]

A universal stirrer was charged with 1500 g of the Nd—Fe—B-based magnetic particles obtained in the above "Precursor 2". Then, 31.5 g of an alkoxy oligomer whose molecular end was capped with an alkoxysilyl group (2.1% by weight based on the Nd—Fe—B-based magnetic particles), 13.5 g of orthophosphoric acid (0.90% by weight based on the Nd—Fe—B-based magnetic particles) and 13.5 g of pure water (0.90% by weight based on the Nd—Fe—B-based magnetic particles) were respectively weighed and then mixed with 112.5 g of a diluting solution (7.50% by weight based on the Nd—Fe—B-based magnetic particles). Thereafter, the obtained treating agent mixture was directly added to the Nd—Fe—B-based magnetic particles, and then mixed therewith in air for 10 min. After completion of the addition, the obtained mixture was heat-treated at 80° C. for 1 hr and then at 120° C. for 2.5 hr in air under an atmospheric pressure while stirring, thereby obtaining Nd—Fe—B-based magnetic particles whose surface was coated with a composite coating layer comprising the silicon compound and the phosphoric acid compound.

[Precursor 14]

A universal stirrer was charged with 1500 g of the Nd—Fe—B-based magnetic particles obtained in the above "Precursor 2". Then, 46.5 g of an alkoxy oligomer whose molecular end was capped with an alkoxysilyl group (3.1% by weight based on the Nd—Fe—B-based magnetic particles), 20.25 g of orthophosphoric acid (1.35% by weight based on the Nd—Fe—B-based magnetic particles) and 19.95 g of pure water (1.33% by weight based on the Nd—Fe—B-based magnetic particles) were respectively weighed and then mixed with 166.05 g of a diluting solution (11.07% by weight based on the Nd—Fe—B-based magnetic particles). Thereafter, the obtained treating agent mixture was directly added to the Nd—Fe—B-based magnetic particles, and then mixed therewith in air for 10 min. After completion of the addition, the obtained mixture was heat-treated at 80° C. for 1 hr and then at 120° C. for 2.5 hr in air under an atmospheric pressure while stirring, thereby obtaining Nd—Fe—B-based magnetic particles whose surface was coated with a composite coating layer comprising the silicon compound and the phosphoric acid compound.

[Precursor 15]

A universal stirrer was charged with 1500 g of the Nd—Fe—B-based magnetic particles obtained in the above "Precursor 2". Manganese phosphate produced by Nihon Parkerizing Co., Ltd., was weighed (2.0% by weight based on the Nd—Fe—B-based magnetic particles), and mixed with 10.5 g of an alkoxy oligomer whose molecular end was capped with an alkoxysilyl group (0.7% by weight based on the Nd—Fe—B-based magnetic particles) and 197.4 g of a diluting solution (13.16% by weight based on the Nd—Fe—B-based magnetic particles). Thereafter, the obtained mixture was directly added to the Nd—Fe—B-based magnetic particles, and then mixed therewith in nitrogen for 10 min. After completion of the addition, the obtained mixture was heat-treated at 90° C. for 10 min and then at 100° C. for 1 hr in nitrogen while stirring, thereby obtaining Nd—Fe—B-based magnetic particles whose surface was adhered with a composite metal phosphoric acid salt coating layer comprising manganese and the phosphoric acid compound.

[Precursor 16]

A universal stirrer was charged with 1500 g of the Nd—Fe—B-based magnetic particles obtained in the above "Precursor 2". Zinc phosphate produced by Nihon Parkerizing Co., Ltd., was weighed (2.0% by weight based on the Nd—Fe—B-based magnetic particles), and mixed with 10.5 g of an alkoxy oligomer whose molecular end was capped with an alkoxysilyl group (0.7% by weight based on the Nd—Fe—B-based magnetic particles) and 197.4 g of a diluting solution (13.16% by weight based on the Nd—Fe—B-based magnetic particles). Thereafter, the obtained mixture was directly added to the Nd—Fe—B-based magnetic particles, and then mixed therewith in nitrogen for 10 min. After completion of the addition, the obtained mixture was heat-treated at 90° C. for 10 min and then at 100° C. for 1 hr in nitrogen while stirring, thereby obtaining Nd—Fe—B-based magnetic particles whose surface was adhered with a composite metal phosphoric acid salt coating layer comprising zinc and the phosphoric acid compound.

[Precursor 17]

A universal stirrer was charged with 1500 g of the Nd—Fe—B-based magnetic particles obtained in the above "Precursor 5". Then, 1.92 g of aluminum isopropoxide ($C_9H_2O_3Al$; 0.128% by weight based on the Nd—Fe—B-based magnetic particles), 10.5 g of orthophosphoric acid (0.7% by weight based on the Nd—Fe—B-based magnetic particles), 10.5 g of an alkoxy oligomer whose molecular end was capped with an alkoxysilyl group (0.7% by weight based on the Nd—Fe—B-based magnetic particles), 8.4 g of pure water and 317.4 g of a diluting solution (21.16% by weight based on the Nd—Fe—B-based magnetic particles) were mixed with each other. Thereafter, the obtained mixture was directly added to the Nd—Fe—B-based magnetic particles, and then mixed therewith in nitrogen for 10 min. After completion of the addition, the obtained mixture was heat-treated at 90° C. for 10 min and then at 100° C. for 1 hr in nitrogen while stirring, thereby obtaining Nd—Fe—B-based magnetic particles whose surface was adhered with a composite coating layer comprising aluminum, the silicon compound and the phosphoric acid compound.

[Precursor 18]

A universal stirrer was charged with 1500 g of the Sm—Fe—N-based magnetic particles obtained in the above "Precursor 7". Then, 10.5 g of an alkoxy oligomer whose molecular end was capped with an alkoxysilyl group (0.70% by weight based on the Sm—Fe—N-based magnetic particles), 4.5 g of orthophosphoric acid (0.30% by weight based on the Sm—Fe—N-based magnetic particles) and 3.9 g of pure water (0.26% by weight based on the Sm—Fe—N-based magnetic particles) were respectively weighed and then mixed with 37.5 g of a diluting solution (2.50% by weight based on the Sm—Fe—N-based magnetic particles). Thereafter, the obtained treating agent mixture was directly added to the Sm—Fe—N-based magnetic particles, and then mixed therewith in air for 10 min. After completion of the addition, the obtained mixture was heat-treated at 80° C. for 1 hr and then at 120° C. for 2.5 hr in air under an atmospheric pressure while stirring, thereby obtaining Sm—Fe—N-based magnetic particles whose surface was coated with a composite coating layer comprising the silicon compound and the phosphoric acid compound.

Various properties of the Nd—Fe—B-based magnetic particles and Sm—Fe—N-based magnetic particles treated with the phosphoric acid compound are shown in Table 1.

Various properties of the Nd—Fe—B-based magnetic particles and Sm—Fe—N-based magnetic particles treated with the silicon compound and the phosphoric acid compound are shown in Table 2.

TABLE 1

| | Magnetic particles used | Amount of phosphoric acid added (wt %) | Amount of IPA added (wt %) |
|---|---|---|---|
| Precursor 1 | Sample A | 0.25 | 1.25 |
| Precursor 2 | Sample A | 0.50 | 2.5 |
| Precursor 3 | Sample A | 0.75 | 3.8 |
| Precursor 4 | Sample A | 0.50 | 2.5 |
| Precursor 5 | Sample A | 0.50 | 2.5 |
| Precursor 6 | Sample A | 0.50 | 2.5 |
| Precursor 7 | Sample B | 0.50 | 2.5 |

| | Phosphoric acid-treating temperature (° C.) | Analyzed value of P (ppm) | CD (g/cc) |
|---|---|---|---|
| Precursor 1 | 80→120 | 340 | 4.88 |
| Precursor 2 | 80→120 | 727 | 4.94 |
| Precursor 3 | 80→120 | 1139 | 4.96 |
| Precursor 4 | 80 | 734 | 4.94 |
| Precursor 5 | 80→100 | 808 | 4.94 |
| Precursor 6 | 80→150 | 728 | 4.94 |
| Precursor 7 | 80→120 | 1592 | 4.19 |

| | BET specific surface area ($m^2/g$) | Rate of change in specific surface area (%) | Elution of Fe (mg/L) |
|---|---|---|---|
| Precursor 1 | 0.07 | +175 | 14.45 |
| Precursor 2 | 0.18 | +450 | 8.20 |
| Precursor 3 | 0.31 | +775 | 8.40 |
| Precursor 4 | 0.30 | +750 | 10.25 |
| Precursor 5 | 0.32 | +800 | 10.1 |
| Precursor 6 | 0.31 | +775 | 10.00 |
| Precursor 7 | 0.60 | +55 | 21.55 |

TABLE 2

| | Magnetic particles used | Amount of treating agent 1 added (wt %) | Amount of treating agent 2 added (wt %) | Diluting solution (wt %) |
|---|---|---|---|---|
| Precursor 8 | Precursor 2 | 0.70 | 0.30 | 2.50 |
| Precursor 9 | Precursor 2 | 0.70 | 0.30 | 2.50 |
| Precursor 10 | Precursor 2 | 0.70 | 0.30 | 2.50 |
| Precursor 11 | Precursor 2 | 0.35 | 0.15 | 1.25 |
| Precursor 12 | Precursor 2 | 1.05 | 0.45 | 3.75 |
| Precursor 13 | Precursor 2 | 2.10 | 0.90 | 7.50 |
| Precursor 14 | Precursor 2 | 3.10 | 1.35 | 11.07 |
| Precursor 15 | Precursor 2 | Mn: 2.0 | 0.70 | 13.16 |
| Precursor 16 | Precursor 2 | Zn: 2.0 | 0.70 | 13.16 |
| Precursor 17 | Precursor 2 | Al: 0.128 | 0.70 | 21.16 |
| Precursor 18 | Precursor 7 | 0.70 | 0.30 | 2.50 |

| | $H_2O$ (wt %) | Treating temp. (° C.) | Analyzed value of Si (ppm) | Analyzed value of P (ppm) |
|---|---|---|---|---|
| Precursor 8 | 0.26 | 60 | 1084 | 1838 |
| Precursor 9 | 0.26 | 80→120 | 1043 | 1829 |
| Precursor 10 | 0.26 | 80→180 | 1097 | 1874 |
| Precursor 11 | 0.15 | 80→120 | 531 | 1379 |
| Precursor 12 | 0.45 | 80→120 | 1538 | 2055 |
| Precursor 13 | 0.90 | 80→120 | 3006 | 3370 |
| Precursor 14 | 1.33 | 80→120 | 4585 | 4613 |
| Precursor 15 | 0.26 | 90→100 | 1110 | 2250 |
| Precursor 16 | 0.26 | 90→100 | 1125 | 1311 |
| Precursor 17 | 0.56 | 90→100 | 1059 | 1871 |
| Precursor 18 | 0.26 | 80→120 | 1347 | 2247 |

TABLE 2-continued

| | Other analyzed values (ppm) | CD (g/cc) | BET specific surface area ($m^2/g$) | Elution of Fe (mg/L) |
|---|---|---|---|---|
| Precursor 8 | — | 4.85 | 1.49 | 8.18 |
| Precursor 9 | — | 4.81 | 1.44 | 7.20 |
| Precursor 10 | — | 4.87 | 1.61 | 7.30 |
| Precursor 11 | — | 4.93 | 0.18 | 8.11 |
| Precursor 12 | — | 4.84 | 2.72 | 7.45 |
| Precursor 13 | — | 4.70 | 3.33 | 7.39 |
| Precursor 14 | — | 4.57 | 4.01 | 7.34 |
| Precursor 15 | Mn (1372 ppm) | 4.93 | 0.19 | 7.35 |
| Precursor 16 | Zn (1288 ppm) | 4.93 | 0.10 | 8.00 |
| Precursor 17 | Al (3067 ppm) | 4.86 | 0.18 | 7.65 |
| Precursor 18 | — | 4.31 | 0.31 | 7.12 |

The Nd—Fe—B-based magnetic particles and the Sm—Fe—N-based magnetic particles obtained in the above "Precursor 1" to "Precursor 7" were subjected to compositional analysis by ICP. The analyzed values of P of these magnetic particles are shown in Table 1. As a result, it was confirmed that the phosphoric acid compounds as desired were adhered on the respective magnetic particles.

The Nd—Fe—B-based magnetic particles and the Sm—Fe—N-based magnetic particles obtained in the above "Precursor 1" to "Precursor 7" were respectively subjected to measurement of a compressed density (CD) thereof. The measurement results are shown in Table 1. As a result, it was confirmed that the compressed density (CD) of the Nd—Fe—B-based magnetic particles was slightly increased by treating the magnetic particles with the phosphoric acid compound, whereas the compressed density (CD) of the Sm—Fe—N-based magnetic particles was slightly decreased by treating the magnetic particles with the phosphoric acid compound.

The amounts of Fe eluted from the Nd—Fe—B-based magnetic particles and the Sm—Fe—N-based magnetic particles obtained in the above "Precursors 1" to "Precursor 7" which were treated by varying the amounts of the respective components added and the heating temperature, were measured. As shown in Table 1, it was confirmed that the Nd—Fe—B-based magnetic particles obtained by treating the sample A with 0.5% by weight of orthophosphoric acid and 2.5% by weight of the diluting solution based on the sample A, followed by heat-treatments at temperatures of 80° C. and 120° C., exhibited the smallest elution of Fe.

The Nd—Fe—B-based magnetic particles and the Sm—Fe—N-based magnetic particles obtained in the above "Precursor 8" to "Precursor 14" and "Precursor 18" were subjected to compositional analysis by ICP. The analyzed values of Si and P were those shown in Table 2. As a result, it was confirmed that the silicon compounds and phosphoric acid compounds as desired were adhered onto the magnetic particles.

The Nd—Fe—B-based magnetic particles obtained in the above "Precursor 15" to "Precursor 17" were subjected to compositional analysis by ICP. The analyzed values of Mn, Zn, Al and P were those shown in Table 2. As a result, it was confirmed that the silicon compounds and phosphoric acid compounds as desired were adhered onto the magnetic particles.

The Nd—Fe—B-based magnetic particles and the Sm—Fe—N-based magnetic particles obtained in the above "Precursor 8" to "Precursor 17" were respectively subjected to measurement of a compressed density (CD) thereof. The measurement results are shown in Table 2. As a result, it was confirmed that the compressed density (CD) of the Nd—Fe—B-based magnetic particles was slightly decreased by treating the magnetic particles with the silicon compound and the phosphoric acid compound, whereas the compressed density (CD) of the Sm—Fe—N-based magnetic particles obtained in the above "Precursor 18" was increased by the treatment.

The Nd—Fe—B-based magnetic particles and the Sm—Fe—N-based magnetic particles obtained in the above "Precursor 8" to "Precursor 18" were respectively subjected to measurement of a specific surface area thereof by a BET method. The measurement results are shown in Table 2. As a result, it was confirmed that the specific surface areas of these magnetic particles were increased as compared to those of the precursors 2 and 7, and therefore the change in surface condition of the magnetic particles was caused by forming the composite metal phosphoric acid salt coating layer comprising the silicon compound and the phosphoric acid compound thereon.

The amounts of Fe eluted from the Nd—Fe—B-based magnetic particles obtained in the above "Precursor 8" to "Precursor 17" which were treated by varying the amounts of the respective components added and the heating temperature, were measured. As shown in Table 2, it was confirmed that the Nd—Fe—B-based magnetic particles obtained by treating the magnetic particles obtained in the above "Precursor 2" with 0.7% by weight of the alkoxy oligomer, 0.3% by weight of orthophosphoric acid, 2.5% by weight of the diluting solution and 0.26% by weight of pure water based on the magnetic particles, followed by heat-treatments at temperatures of 80° C. and 120° C., exhibited the smallest elution of Fe.

Comparative Example 1

A universal stirrer was charged with 1500 g of the Nd—Fe—B-based magnetic particles obtained in the above "Precursor 2". Then, 10.5 g of an alkoxy oligomer whose molecular end was capped with an alkoxysilyl group (treating agent 1) (0.7% by weight based on the Nd—Fe—B-based magnetic particles) and 3.9 g of pure water (0.26% by weight based on the Nd—Fe—B-based magnetic particles) were respectively weighed and then mixed with 37.5 g of a diluting solution (2.5% by weight based on the Nd—Fe—B-based magnetic particles). Thereafter, the obtained treating agent mixture was directly added to the Nd—Fe—B-based magnetic particles, and then mixed therewith in air for 10 min. After completion of the addition, the obtained mixture was heat-treated at 80° C. for 1 hr and then at 120° C. for 2.5 hr in air under an atmospheric pressure while stirring, thereby obtaining Nd—Fe—B-based magnetic particles whose surface was coated with the silicon compound.

Comparative Example 2

A universal stirrer was charged with 1500 g of the Nd—Fe—B-based magnetic particles obtained in the above "Precursor 2". Then, 30.0 g of an alkoxy oligomer whose molecular end was capped with an alkoxysilyl group (2.0% by weight based on the Nd—Fe—B-based magnetic particles) and 6.3 g of pure water (0.42% by weight based on the Nd—Fe—B-based magnetic particles) were respectively weighed and then mixed with 60 g of a diluting solution (4.0% by weight based on the Nd—Fe—B-based magnetic particles). Thereafter, the obtained treating agent mixture was directly added to the Nd—Fe—B-based magnetic particles, and then mixed therewith in air for 10 min. After completion of the addition, the obtained mixture was heat-treated at 80° C. for 1 hr and then at 120° C. for 2.5 hr in air under an atmospheric pressure while stirring, thereby obtaining Nd—Fe—B-based magnetic particles whose surface was coated with the silicon compound.

Comparative Example 3

A universal stirrer was charged with 1500 g of the Nd—Fe—B-based magnetic particles obtained in the above "Precursor 2". Then, 30.0 g of an alkyl silicate represented by the formula: $Si(OR)_4$ wherein R is an alkyl group having 2 carbon atoms in which a molecular end of the alkyl silicate was capped with an alkoxysilyl group (2.0% by weight based on the Nd—Fe—B-based magnetic particles) and 6.3 g of pure water (0.42% by weight based on the Nd—Fe—B-based magnetic particles) were respectively weighed and then mixed with 60 g of a diluting solution (4.0% by weight based on the Nd—Fe—B-based magnetic particles). Thereafter, the obtained treating agent mixture was directly added to the Nd—Fe—B-based magnetic particles, and then mixed therewith in air for 10 min. After completion of the addition, the obtained mixture was heat-treated at 80° C. for 1 hr and then at 120° C. for 2.5 hr in air under an atmospheric pressure while stirring, thereby obtaining Nd—Fe—B-based magnetic particles whose surface was coated with the silicon compound.

Comparative Example 4

A universal stirrer was charged with 1500 g of the Sm—Fe—N-based magnetic particles obtained in the above "Precursor 7". Then, 10.5 g of an alkoxy oligomer whose molecular end was capped with an alkoxysilyl group (0.7% by weight based on the Sm—Fe—N-based magnetic particles) and 3.9 g of pure water (0.26% by weight based on the Sm—Fe—N-based magnetic particles) were respectively weighed and then mixed with 37.5 g of a diluting solution (2.5% by weight based on the Sm—Fe—N-based magnetic particles). Thereafter, the obtained treating agent mixture was directly added to the Sm—Fe—N-based magnetic particles, and then mixed therewith in air for 10 min. After completion of the addition, the obtained mixture was heat-treated at 80° C. for 1 hr and then at 120° C. for 2.5 hr in air under an atmospheric pressure while stirring, thereby obtaining Sm—Fe—N-based magnetic particles whose surface was coated with the silicon compound.

Various properties of the thus obtained surface-treated Sm—Fe—N-based magnetic particles are shown in Table 3.

TABLE 3

| | Magnetic particles used | Treating agent used | Amount of treating agent 1 added (wt %) | Amount of treating agent 2 added (wt %) |
|---|---|---|---|---|
| Comparative Example 1 | Precursor 2 | Alkyl silicate oligomer | 0.70 | — |

TABLE 3-continued

| | | | | |
|---|---|---|---|---|
| Comparative Example 2 | Precursor 2 | Alkyl silicate oligomer | 2.00 | — |
| Comparative Example 3 | Sample A | Alkyl silicate monomer | 2.00 | — |
| Comparative Example 4 | Sample B | Alkyl silicate oligomer | 0.70 | — |

| | Diluting solution (wt %) | $H_2O$ (wt %) | Treating temp. of alkyl silicate (° C.) | Analyzed value of Si (ppm) |
|---|---|---|---|---|
| Comparative Example 1 | 2.50 | 0.26 | 80→120 | 903.3 |
| Comparative Example 2 | 4.00 | 0.42 | 80→120 | 1870.9 |
| Comparative Example 3 | 4.00 | 0.42 | 80→120 | 267.0 |
| Comparative Example 4 | 2.50 | 0.26 | 80→120 | 1345 |

| | Analyzed value of P (ppm) | CD (g/cc) | BET specific surface area ($m^2/g$) | T-C (wt %) | Elution of Fe (mg/L) |
|---|---|---|---|---|---|
| Comparative Example 1 | 726.0 | 4.87 | 2.13 | 0.04 | 8.00 |
| Comparative Example 2 | 734.0 | 4.72 | 3.71 | 0.70 | 8.03 |
| Comparative Example 3 | 748.0 | 4.80 | 0.04 | 0.020 | 7.98 |
| Comparative Example 4 | 1570 | 4.39 | 0.20 | 0.13 | 7.15 |

Example 1

To 1500 g of the Nd—Fe—B-based magnetic particles obtained in the above "Precursor 8" was directly added a mixed solution comprising 7.5 g of a silane coupling agent (γ-aminopropyl triethoxysilane) (0.5% by weight based on the Nd—Fe—B-based magnetic particles), 35 g of IPA (2.5% by weight based on the Nd—Fe—B-based magnetic particles) and 4.5 g of pure water (0.3% by weight based on the Nd—Fe—B-based magnetic particles), and the resulting mixture was stirred in a nitrogen gas for 10 min using a universal stirrer. Thereafter, the mixture was heat-treated at 100° C. for 1 hr in a nitrogen atmosphere while stirring, and then cooled to withdraw the magnetic particles therefrom. Then, the resulting magnetic particles were heat-treated at 120° C. for 2.0 hr in an inert gas under an atmospheric pressure, thereby obtaining Nd—Fe—B-based magnetic particles whose surface was coated with a coating layer comprising the silicon compound and the phosphoric cid compound onto which Si of the silane coupling agent was further adhered.

Examples 2 to 10

The same procedure as defined in Example 1 was conducted except that the kinds of precursors used were variously changed, thereby obtaining surface-treated Nd—Fe—B-based magnetic particles.

Example 11

To 1500 g of the Sm—Fe—N-based magnetic particles obtained in the above "Precursor 18" was directly added a mixed solution comprising 15.0 g of a silane coupling agent (γ-aminopropyl triethoxysilane) (0.5% by weight based on the Nd—Fe—B-based magnetic particles), 35 g of IPA (2.5% by weight based on the Nd—Fe—B-based magnetic particles) and 4.5 g of pure water (0.3% by weight based on the Nd—Fe—B-based magnetic particles), and the resulting mixture was stirred in a nitrogen gas for 10 min using a universal stirrer. Thereafter, the mixture was heat-treated at 100° C. for 1 hr in a nitrogen atmosphere while stirring, and then cooled to withdraw the magnetic particles therefrom. Then, the resulting magnetic particles were heat-treated at 120° C. for 2.0 hr in an inert gas under an atmospheric pressure, thereby obtaining Sm—Fe—N-based magnetic particles whose surface was coated with a coating layer comprising the silicon compound and the phosphoric cid compound onto which Si of the silane coupling agent was further adhered.

Various properties of the thus treated Sm—Fe—N-based magnetic particles are shown in Table 4.

TABLE 4

| | Magnetic particles used | Amount of silane coupling agent added (wt %) | Diluting solution (wt %) |
|---|---|---|---|
| Example 1 | Precursor 8 | 0.5 | 2.50 |
| Example 2 | Precursor 9 | 0.5 | 2.50 |
| Example 3 | Precursor 10 | 0.5 | 2.50 |
| Example 4 | Precursor 11 | 0.5 | 2.50 |
| Example 5 | Precursor 12 | 0.5 | 2.50 |
| Example 6 | Precursor 13 | 0.5 | 2.50 |
| Example 7 | Precursor 14 | 0.5 | 2.50 |
| Example 8 | Precursor 15 | 0.5 | 2.50 |
| Example 9 | Precursor 16 | 0.5 | 2.50 |
| Example 10 | Precursor 17 | 0.5 | 2.50 |
| Example 11 | Precursor 18 | 0.5 | 2.50 |

| | $H_2O$ (wt %) | Analyzed value of Si (ppm) | Analyzed value of P (ppm) | CD (g/cc) |
|---|---|---|---|---|
| Example 1 | 0.30 | 1282 | 1757 | 4.93 |
| Example 2 | 0.30 | 1283 | 1713 | 4.89 |
| Example 3 | 0.30 | 1289 | 1778 | 4.95 |
| Example 4 | 0.30 | 649 | 1279 | 5.01 |
| Example 5 | 0.30 | 1867 | 1975 | 4.92 |
| Example 6 | 0.30 | 3009 | 3413 | 4.77 |
| Example 7 | 0.30 | 5533 | 4469 | 4.64 |
| Example 8 | 0.30 | 846 | 2960 | 5.00 |
| Example 9 | 0.30 | 880 | 1229 | 5.00 |
| Example 10 | 0.30 | 903 | 1729 | 4.91 |
| Example 11 | 0.30 | 2637 | 2555 | 4.26 |

| | BET specific surface area ($m^2/g$) | Rate of decrease in specific surface area (%) | T-C (wt %) | Elution of Fe (mg/L) |
|---|---|---|---|---|
| Example 1 | 0.77 | 51.7 | 0.10 | 1.21 |
| Example 2 | 0.62 | 43.1 | 0.10 | 0.95 |
| Example 3 | 0.72 | 44.7 | 0.10 | 0.96 |
| Example 4 | 0.08 | 42.8 | 0.11 | 1.23 |
| Example 5 | 1.33 | 48.9 | 0.09 | 0.99 |
| Example 6 | 1.52 | 45.6 | 0.11 | 0.98 |
| Example 7 | 1.72 | 43.0 | 0.10 | 0.96 |
| Example 8 | 0.02 | 10.5 | 0.09 | 1.5 |
| Example 9 | 0.05 | 50.0 | 0.10 | 1.35 |
| Example 10 | 0.01 | 5.6 | 0.13 | 4.4 |
| Example 11 | 0.41 | * | 0.10 | 0.92 |

Note
*: Increased by 130.6%

The Nd—Fe—B-based magnetic particles obtained in Examples 1 to 10 onto which the silicon compound was adhered, were subjected to compositional analysis by ICP. The analyzed values of Si are shown in Table 4. As a result, it was confirmed that the desired amount of Si was adhered onto the magnetic particles.

The Sm—Fe—N-based magnetic particles obtained in Example 11 onto which the silicon compound was adhered, were subjected to compositional analysis by X-F. The analyzed values of Si are shown in Table 4. As a result, it was confirmed that the desired amount of Si was adhered onto the magnetic particles.

The Nd—Fe—B-based magnetic particles obtained in Examples 1 to 10 onto which the silicon compound was adhered, were subjected to measurement of a specific surface area thereof by a BET method. The measurement results are shown in Table 4. As shown in Table 4, the rates of decrease in the specific surface area of the magnetic particles between after formation of the coating layer comprising the silicon compound and the phosphoric acid compound and after the treatment with the silane coupling agent (after the treatment with the silane coupling agent/before the treatment with the silane coupling agent) were in the range of 5% to 60%. Thus, it was confirmed that all of the Nd—Fe—B-based magnetic particles obtained in Examples 1 to 10 were decreased in BET specific surface area thereof. From the results, it was estimated that Si was uniformly adhered onto the surface of the respective Nd—Fe—B-based magnetic particles.

The Sm—Fe—N-based magnetic particles obtained in Example 11 onto which the silicon compound was adhered, were subjected to measurement of a specific surface area thereof by a BET method. The measurement results are shown in Table 4. As shown in Table 4, the rate of change in the BET specific surface area of the magnetic particles between after formation of the coating layer comprising the silicon compound and the phosphoric acid compound and after the treatment with the silane coupling agent was +130.64% (increased). From this result, it was estimated that the silicon compound and the phosphoric acid compound were adhered onto the surface of the respective Sm—Fe—N-based magnetic particles.

The Nd—Fe—B-based magnetic particles obtained in Examples 1 to 10 were subjected to measurement of elution of Fe therefrom. As shown in Table 4, it was confirmed that when treated with the silane coupling agent, elution of Fe from the magnetic particles could be further suppressed as compared to the magnetic particles before treated with the silane coupling agent.

The Sm—Fe—N-based magnetic particles obtained in Example 11 were subjected to measurement of elution of Fe therefrom. As shown in Table 4, it was confirmed that when treated with the silane coupling agent, elution of Fe from the magnetic particles could be further suppressed as compared to the magnetic particles before treated with the silane coupling agent.

Comparative Examples 5 to 7

In the same manner as defined in Example 1, 1500 g of the Nd—Fe—B-based magnetic particles obtained in Comparative Examples 1 to 3 were treated with the silane coupling agent, thereby obtaining Nd—Fe—B-based magnetic particles which were adhered with Si onto which Si of the silane coupling agent was further adhered.

Comparative Example 8

In the same manner as defined in Example 11, 1500 g of the Sm—Fe—N-based magnetic particles obtained in Comparative Example 4 were treated with the silane coupling agent, thereby obtaining Sm—Fe—N-based magnetic particles which were adhered with Si onto which Si of the silane coupling agent was further adhered.

The amounts of Fe eluted from the Nd—Fe—B-based magnetic particles and the Sm—Fe—N-based magnetic particles obtained in Comparative Examples 5 to 8 are shown in Table 5.

TABLE 5

| | Magnetic particles used | Amount of silane coupling agent added (wt %) | Diluting solution (wt %) |
|---|---|---|---|
| Comparative Example 5 | Comparative Example 1 | 0.5 | 2.50 |
| Comparative Example 6 | Comparative Example 2 | 0.5 | 2.50 |
| Comparative Example 7 | Comparative Example 3 | 0.5 | 2.50 |
| Comparative Example 8 | Comparative Example 4 | 0.5 | 2.50 |

| | $H_2O$ (wt %) | Analyzed value of Si (ppm) | Analyzed value of P (ppm) | CD (g/cc) |
|---|---|---|---|---|
| Comparative Example 5 | 0.30 | 1268 | 719.0 | 4.95 |
| Comparative Example 6 | 0.30 | 2076 | 734.6 | 4.79 |
| Comparative Example 7 | 0.30 | 519 | 748.8 | 4.88 |
| Comparative Example 8 | 0.30 | 2213 | 1583.65 | 4.20 |

| | BET specific surface area ($m^2/g$) | Rate of decrease in specific surface area (%) | T-C (wt %) | Elution of Fe (mg/L) |
|---|---|---|---|---|
| Comparative Example 5 | 0.94 | 44.1 | 0.11 | 2.17 |
| Comparative Example 6 | 1.63 | 43.9 | 0.12 | 2.76 |
| Comparative Example 7 | 0.02 | 50.0 | 0.11 | 2.85 |
| Comparative Example 8 | 0.15 | 75.0 | 0.22 | 4.12 |

Examples 12 to 21

Using a Henschel mixer, 88.81 parts by weight of the Nd—Fe—B-based magnetic particles obtained in Examples 1 to 10 and 8.91 parts by weight of a polyphenylene sulfide resin were mixed with each other, and then the resulting mixture was kneaded (at a kneading temperature of 300° C.) using a twin-screw extrusion kneader to obtain pellets. The thus obtained pellets were injection-molded to produce respective bonded magnets.

Example 22

Using a Henschel mixer, 91.64 parts by weight of the Sm—Fe—N-based magnetic particles obtained in Example 11, 7.34 parts by weight of 12 nylon, 0.51 part by weight of an antioxidant and 1.0 part by weight of the surface-treating agent 1 were mixed with each other, and then the resulting mixture was kneaded (at a kneading temperature of 190° C.)

using a twin-screw extrusion kneader to obtain pellets. The thus obtained pellets were injection-molded to produce a bonded magnet.

Various properties of the thus obtained bonded magnets are shown in Table 6.

Comparative Examples 9 to 11

The bonded magnets were produced in the same manner as defined in Examples 12 to 21 except that the kinds of surface-treated Nd—Fe—B-based magnetic particles used were changed variously.

Comparative Example 12

The bonded magnet was produced in the same manner as defined in Example 22 except that the kind of surface-treated Sm—Fe—B-based magnetic particles used was changed.

TABLE 6

| | Magnetic particles used | MI g/10 min | Injection pressure Kg/cm$^2$ | (BH)max MGOe | (BH)max kJ/m$^3$ |
|---|---|---|---|---|---|
| Example 12 | Example 1 | 20 | 1536 | 10.33 | 82.26 |
| Example 13 | Example 2 | 14 | 1601 | 10.34 | 82.33 |
| Example 14 | Example 3 | 15 | 1555 | 10.30 | 82.02 |
| Example 15 | Example 4 | 26 | 1543 | 10.34 | 82.34 |
| Example 16 | Example 5 | 29 | 1567 | 10.29 | 81.94 |
| Example 17 | Example 6 | 25 | 1512 | 10.19 | 81.14 |
| Example 18 | Example 7 | 25 | 1523 | 10.09 | 80.35 |
| Example 19 | Example 8 | 36 | 1611 | 10.4 | 82.82 |
| Example 20 | Example 9 | 20 | 1668 | 10.76 | 85.68 |
| Example 21 | Example 10 | 38 | 1555 | 10.57 | 84.17 |
| Example 22 | Example 11 | 477 | 1117 | 11.31 | 82.33 |
| Comparative Example 9 | Comparative Example 5 | 16 | 1670 | 10.02 | 79.76 |
| Comparative Example 10 | Comparative Example 6 | 19 | 1523 | 10.21 | 81.32 |
| Comparative Example 11 | Comparative Example 7 | 18 | 1638 | 10.27 | 81.75 |
| Comparative Example 12 | Comparative Example 8 | 484 | 1108 | 10.16 | 80.90 |

| | iHC Oe | iHC kA/m | bHc Oe | bHc kA/m |
|---|---|---|---|---|
| Example 12 | 13993 | 1113.5 | 5754 | 457.9 |
| Example 13 | 13745 | 1096.0 | 5750 | 458.7 |
| Example 14 | 13078 | 1040.7 | 5759 | 458.3 |
| Example 15 | 13529 | 1076.6 | 5779 | 459.9 |
| Example 16 | 13636 | 1085.1 | 5748 | 457.4 |
| Example 17 | 13661 | 1087.1 | 5711 | 454.5 |
| Example 18 | 13093 | 1041.9 | 5680 | 452.0 |
| Example 19 | 12976 | 1035.0 | 5713 | 455.7 |
| Example 20 | 13623 | 1087.0 | 5847 | 466.4 |
| Example 21 | 13391 | 1068.0 | 5798 | 462.5 |
| Example 22 | 8167 | 649.9 | 5566 | 442.9 |
| Comparative Example 9 | 13924 | 1108.1 | 5748 | 457.4 |
| Comparative Example 10 | 13099 | 1042.3 | 5745 | 457.2 |
| Comparative Example 11 | 13226 | 1052.5 | 5779 | 459.9 |
| Comparative Example 12 | 8196 | 652.2 | 5641 | 448.9 |

| | Br G | Br T | r/s (%) | Rust prevention property |
|---|---|---|---|---|
| Example 12 | 6866 | 686.6 | 91.23 | ○ |
| Example 13 | 6873 | 687.3 | 91.80 | ◎◎ |
| Example 14 | 6871 | 687.1 | 91.07 | ◎ |
| Example 15 | 6869 | 686.9 | 91.32 | ○ |
| Example 16 | 6799 | 679.9 | 91.10 | ◎ |
| Example 17 | 6780 | 678.0 | 92.11 | ○ |
| Example 18 | 6750 | 675.0 | 91.10 | ○ |
| Example 19 | 6921 | 692.1 | 91.90 | ○ |
| Example 20 | 7007 | 700.7 | 92.21 | ○ |
| Example 21 | 6952 | 695.2 | 92.00 | ○ |
| Example 22 | 7068 | 707.2 | 96.26 | ◎ |
| Comparative Example 9 | 6962 | 696.6 | 91.39 | Δ |
| Comparative Example 10 | 6980 | 698.7 | 91.91 | Δ |
| Comparative Example 11 | 6869 | 687.2 | 91.09 | Δ |
| Comparative Example 12 | 7005 | 696.0 | 96.45 | ○ |

The bonded magnet molded products were evaluated for rust prevention property thereof. As shown in Table 6, it was confirmed that the bonded magnets obtained in Examples 12 to 21 which were produced using the surface-treated Nd—Fe—B-based magnetic particles all exhibited an excellent rust prevention property and a high coercive force $_iH_c$, in particular, a coercive force of not less than 716.2 kA/m (9000 Oe), as compared to those obtained in Comparative Examples 9 to 11. In Example 13, no formation rusts was recognized even after the elapse of 1000 hr, therefore the bonded magnet obtained in Example 13 was especially excellent in rust prevention property. In addition, it was confirmed that the bonded magnet obtained in Example 22 which was produced using the surface-treated Sm—Fe—N-based magnetic particles, was excellent in rust prevention property as compared to the bonded magnet obtained in Comparative Example 12. Meanwhile, MI indicating the flowability of the resin composition comprising the Sm—Fe—N-based magnetic particles was not less than 400 g/10 min. Therefore, it was confirmed that the resin composition comprising the Sm—Fe—N-based magnetic particles had a high flowability.

Figure 2:
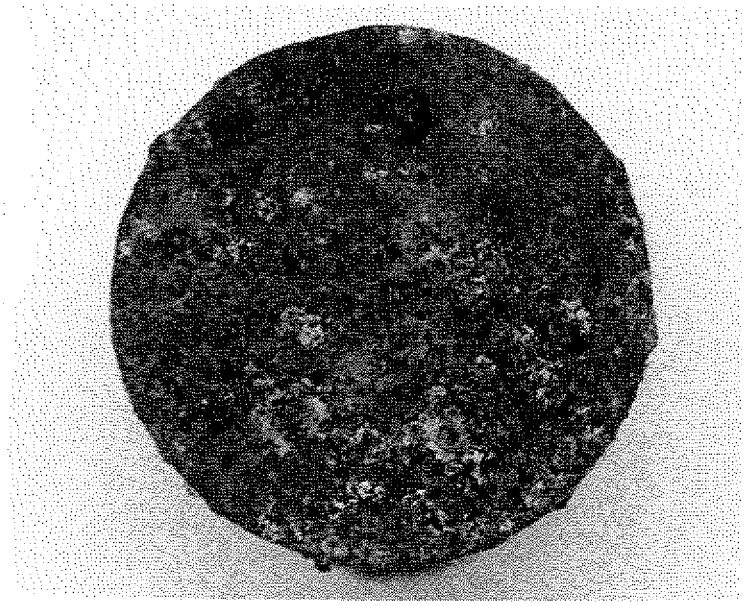
FIG. 2 shows the results of a rust prevention test of a bonded magnet obtained in Comparative Example 11.

The results of a rust prevention test of the bonded magnets obtained in Example 13 and Comparative Example 11 are shown in FIG. 1 and FIG. 2, respectively. As a result, it was confirmed that the bonded magnet obtained in Example 13 (FIG. 1) was substantially free from formation of rusts, whereas the bonded magnet obtained in Comparative Example 11 (FIG. 2) suffered from considerable formation of rusts.

Figure 3:
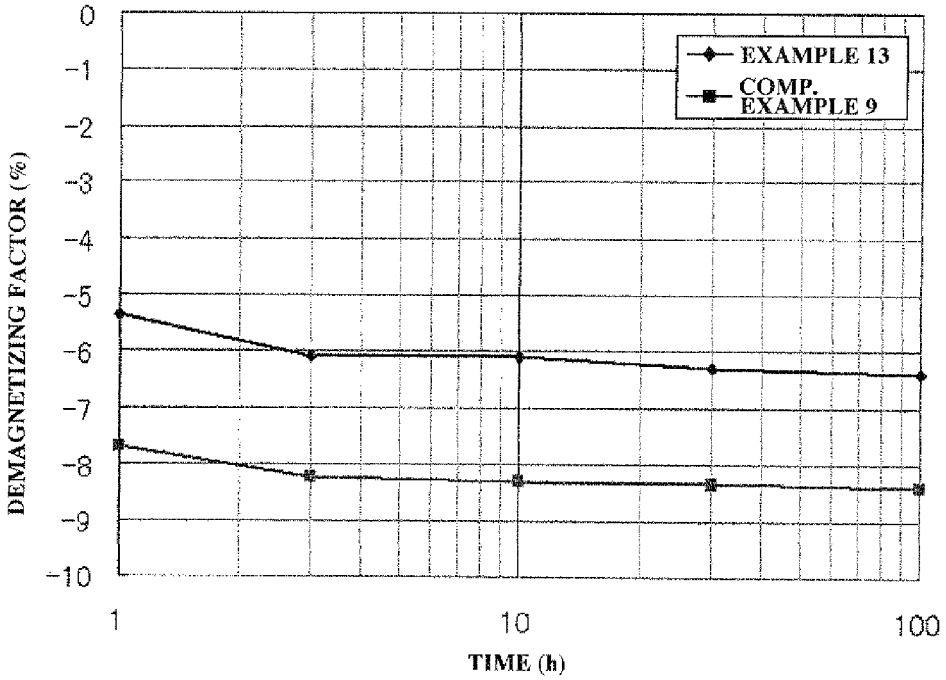
FIG. 3 shows the results of measurement of an irreversible demagnetizing factor of each of the bonded magnets obtained in Example 13 and Comparative Example 11.

The measurement results of irreversible demagnetizing factors of the bonded magnets obtained in Example 13 and Comparative Example 9 as measured at a temperature of 100° C. for 100 hr are shown in FIG. 3. As shown in FIG. 3, it was confirmed that the bonded magnet obtained in Example 13 was improved in irreversible demagnetizing factor by about 2% as compared to the bonded magnet obtained in Comparative Example 11.

INDUSTRIAL APPLICABILITY

In the surface-treated Nd—Fe—B-based magnetic particles and Sm—Fe—N-based magnetic particles according to the present invention, the silicon compound and the phosphoric acid compound are adhered on the surface of the magnetic particles, so that the bonded magnet produced using the magnetic particles can be enhanced in rust prevention property. Therefore, these surface-treated magnetic particles are suitable as Nd—Fe—B-based magnetic particles and Sm—Fe—N-based magnetic particles for bonded magnets. According to the present invention, the resulting bonded magnet can be used under more severe corrosive environmental conditions in which any conventional bonded magnets are not usable.

The invention claimed is:

1. Surface-treated rare earth-based magnetic particles comprising rare-earth-based magnetic particles, a first coating layer comprising a phosphoric acid compound which is formed on a surface of the respective rare-earth-based magnetic particles, and a second coating layer in the form of a composite coating film comprising a silicon compound and a phosphoric acid compound, which is formed on a surface of the first coating layer, an amount of Fe eluted from the rare earth-based magnetic particles being not more than 5 mg/L.

2. Surface-treated rare earth-based magnetic particles according to claim 1, wherein the composite coating film comprising the silicon compound and the phosphoric acid compound which forms the second coating layer comprises a compound produced from the phosphoric acid compound selected from the group consisting of orthophosphoric acid, disodium hydrogen phosphate, pyrophosphoric acid, metaphosphoric acid, manganese phosphate, zinc phosphate and aluminum phosphate, an alkoxy oligomer whose molecular end is capped with an alkoxysilyl group, and a silane coupling agent.

3. Surface-treated rare earth-based magnetic particles according to claim 1, wherein a content of the phosphoric acid compounds in the surface-treated rare earth-based magnetic particles is 0.01 to 2.0% by weight.

4. Surface-treated rare earth-based magnetic particles according to claim 1 wherein a content of Si in the surface-treated rare earth-based magnetic particles is 0.01 to 2.0% by weight.

5. Surface-treated rare earth-based magnetic particles according to claim 1, wherein a content of carbon in the surface-treated rare earth-based magnetic particles is 0.01 to 2.0% by weight.

6. Surface-treated rare earth-based magnetic particles according to claim 1, wherein the rare earth-based magnetic particles are Nd—Fe—B-based magnetic particles.

7. Surface-treated rare earth-based magnetic particles according to claim 1, wherein the rare earth-based magnetic particles are Sm—Fe—N-based magnetic particles.

8. A resin composition for bonded magnets comprising the surface-treated rare earth-based magnetic particles as defined in claim 1, and a resin.

9. A bonded magnet comprising the surface-treated rare earth-based magnetic particles as defined in claim 1.

10. Surface-treated rare earth-based magnetic particles according to claim 1, wherein the amount of Fe eluted from the rare earth-based magnetic particles is not more than 2.5 mg/L.

11. Surface-treated rare earth-based magnetic particles according to claim 1, wherein the phosphoric acid compound forming the first coating layer is selected from the group consisting of orthophosphoric acid, disodium hydrogen phosphate, pyrophosphoric acid, metaphosphoric acid, manganese phosphate, zinc phosphate and aluminum phosphate.

* * * * *